US011766082B2

(12) United States Patent
Weller

(10) Patent No.: US 11,766,082 B2
(45) **Date of Patent: *Sep. 26, 2023**

(54) BALL CAP WITH HIGH BRIM

(71) Applicant: Jeffrey C. Weller, Fredericktown, OH (US)

(72) Inventor: Jeffrey C. Weller, Fredericktown, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/810,886

(22) Filed: Jul. 6, 2022

(65) Prior Publication Data

US 2022/0338589 A1 Oct. 27, 2022

Related U.S. Application Data

(62) Division of application No. 16/255,982, filed on Jan. 24, 2019, now Pat. No. 11,382,374.

(51) Int. Cl.
*A42B 1/0182* (2021.01)
*A42B 1/241* (2021.01)

(52) U.S. Cl.
CPC ..... *A42B 1/0182* (2021.01); *A42B 1/241* (2013.01)

(58) Field of Classification Search
CPC ..... A42B 1/082; A42B 1/083; A42B 1/084; A42B 1/085; A42C 5/02; A42C 5/04
See application file for complete search history.

(56) References Cited

U.S. PATENT DOCUMENTS 2,736,035 A 2/1956 Spreiregen
2,926,356 A 3/1960 Taylor
3,085,252 A 4/1963 Smith
4,114,201 A 9/1978 Garrison
4,827,384 A 5/1989 Von Schlemmer
4,873,726 A 10/1989 Tapia
5,253,364 A 10/1993 Robinson
5,333,328 A 8/1994 Roberts
5,343,568 A 9/1994 May
5,487,191 A 1/1996 Ridley
5,553,325 A 9/1996 Gutierrez
5,566,395 A 10/1996 Nebeker
5,666,669 A 9/1997 Sewell
5,781,933 A 7/1998 De Giacomi
5,898,935 A 5/1999 Davis
(Continued)

FOREIGN PATENT DOCUMENTS

DE 102014101559 A1 8/2015

OTHER PUBLICATIONS

Lee Young; International Search Report and Written Opinion; Application No. PCT/US20/14312; dated Apr. 9, 2020; 11 pages.

*Primary Examiner* — Heather Mangine
(74) *Attorney, Agent, or Firm* — Emerson Thomson Bennett; Daniel A. Thomson

(57) ABSTRACT

A ball cap is provided that has a crown that has a highest crown point located in a vertical direction and a lowest crown point located in the vertical direction. A brim extends forward of the crown in a longitudinal direction of the ball cap, and the brim extends in the vertical direction to a highest brim point. The highest brim point is closer to the highest crown point in the vertical direction than to the lowest crown point in the vertical direction. In other versions of the ball cap, a crown is provided in the ball cap and in yet further versions portions of the crown can be covered by the brim.

4 Claims, 20 Drawing Sheets

(56) References Cited

U.S. PATENT DOCUMENTS

| | | | | |
|---|---|---|---|---|
| 6,308,336 | B1 | 10/2001 | Stephenson | |
| 6,493,880 | B1 | 12/2002 | Lo | |
| 6,675,393 | B1 | 1/2004 | Park | |
| 6,892,398 | B2 | 5/2005 | Wilson | |
| 7,120,937 | B2 | 10/2006 | Monshouwer | |
| 7,716,754 | B1 | 5/2010 | Ross | |
| D658,854 | S | 5/2012 | Cobb | |
| 9,480,292 | B1 | 11/2016 | Kazmierczak | |
| 9,622,528 | B1 | 4/2017 | Pitts et al. | |
| 11,382,374 | B2 * | 7/2022 | Weller | A42B 1/0185 |
| 2002/0144334 | A1 | 10/2002 | Brooks | |
| 2004/0006810 | A1 | 1/2004 | Park | |
| 2005/0193474 | A1 | 9/2005 | Phillip | |
| 2006/0005302 | A1 | 1/2006 | Stephenson | |
| 2008/0115258 | A1 | 5/2008 | Hernandez | |
| 2010/0107308 | A1 | 5/2010 | Hosie et al. | |
| 2011/0088141 | A1 | 4/2011 | Davis | |
| 2011/0234403 | A1 | 9/2011 | Niederer, III | |
| 2011/0302695 | A1 | 12/2011 | Cho | |
| 2012/0000006 | A1 | 1/2012 | Ramer | |
| 2013/0239292 | A1 | 9/2013 | Greene, Jr. | |
| 2013/0318686 | A1 | 12/2013 | Yang | |
| 2015/0000008 | A1 | 1/2015 | Shirai | |
| 2016/0235150 | A1 | 8/2016 | Karimi | |
| 2017/0035134 | A1 | 2/2017 | Olivera, II | |
| 2017/0055618 | A1 | 3/2017 | Fulper | |
| 2017/0273385 | A1 | 9/2017 | Scheller | |
| 2020/0237043 | A1 * | 7/2020 | Weller | A42B 1/24 |

* cited by examiner

BALL CAP WITH HIGH BRIM

This application is a divisional of, and claims priority to, U.S. Ser. No. 16/255,982, filed Jan. 24, 2019, now U.S. Pat. No. 11,382,374. The present invention relates generally to a ball cap, which in some instances may be a baseball cap, that has a brim engaged to a crown of the hat between the front bottom and front top of the hat. In more particular embodiments, the present application relates to a ball cap that has a high brim that can be arranged for holding accessories, for adjustment of the brim, ventilation, aesthetics, shade and/or for the display of information.

FIELD OF THE INVENTION

Background

Ball caps are a known piece of apparel widely worn by men, women, and children alike. Ball caps include a crown and a brim, a visor that is attached to the crown to shade the wearer from sunlight. The angle that the brim extends from the crown may vary in different ball caps to achieve a different look and sun shading effect. The brim is attached to the base of the crown and could be flat or curved in shape to achieve these different properties. The crown itself may also be variously shaped to achieve different looks. The crown may have a high, medium, or low profile in order to make the shape of the crown different so that the ball caps can be provided in different manners.

The crown of the ball cap may include a buckram that is a liner on the inside front of the crown to provide structure and shape to the crown. In some ball caps the buckram is not present and the crown has a more natural profile about the head of the wearer. The crown base can be non-adjustable so that it is a fitted hat that is worn by a user with a specific head size. Alternatively, the back of the crown can be opened with an adjustment mechanism that can be used to increase or decrease the opening of the crown to size the ball cap to the specific head size of the user. Other ways of providing an adjustable ball cap are known. One such alternative way is to make the sweatband stretchable. The sweatband extends 360 degrees around the inside of the crown and functions to hold the hair of the user within the hat and to grasp the head of the wearer to keep it onto his or her head. The fabric making up the crown may be loose or stretchable, and the sweatband can be made of a stretchable material to allow for a tight fit between the hat and the head of the wearer. The front of the sweatband at the front of the crown is not stretchable as the brim attachment to the crown base disallows sweatband stretchability. However, the opening and thus the size of the ball cap may still stretch somewhat because other portions of the sweatband are in fact stretchable. Although it is known to provide ball caps of varying configurations, there remains room for variation and improvement within the art to achieve different ball cap constructions and to provide different features to ball caps.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended FIGS. in which.

Figure 1:
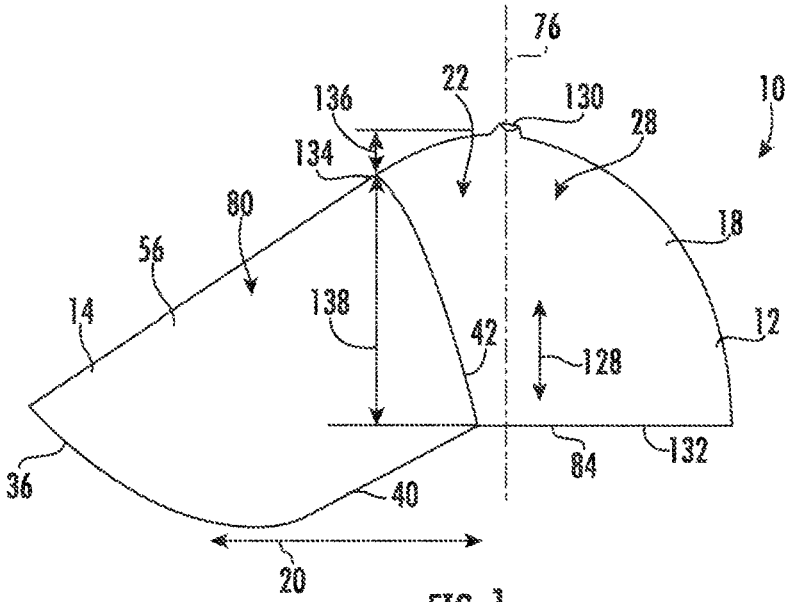
FIG. 1 is a side view of a ball cap.
Figure 2:
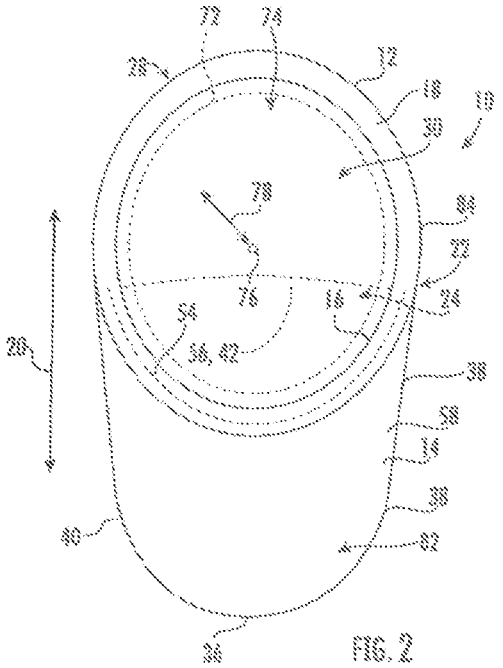
FIG. 2 is a bottom view of the ball cap of FIG. 1.
Figure 3:
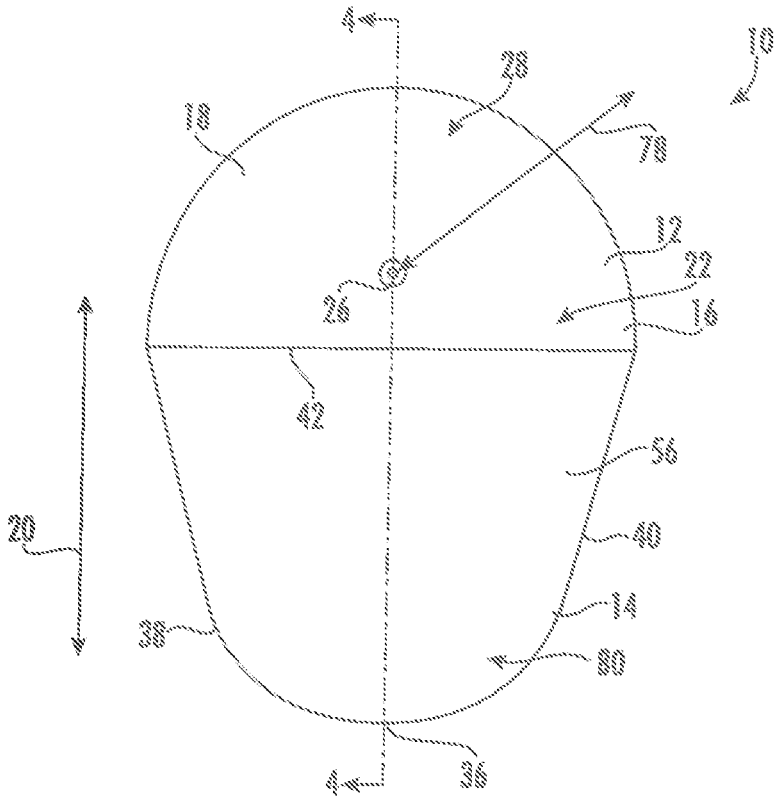
FIG. 3 is a top view of the ball cap of FIG. 1.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present invention provides for a ball cap 10 that has a brim 14 that engages a crown 12 of the ball cap 10 at a high point of the crown 12, or on either side of the high point. The point of engagement may be on or around the front section 16 of the crown 12 in the longitudinal direction 20 but not usually on the back section 18 of the crown 12 nor at the boundary of the front section 16 and back section 18. The brim 14 may be made of a single piece or multiple pieces such that it has an upper brim section 56 and a lower brim section 58, and in some instances may have a support structure. The brim sections 56 and 58 may have surface areas different from one another, and may extend from the crown 12 at different angles to one another. Various versions of the ball cap 10 exist in which the brim 14 is adjustable, defines a storage pocket 50, and has a sweatband 54 that is stretchable that can be located under the brim 14. Yet other versions exist in which the brim 14 extends to the back section 18 of the crown 12 and covers a portion of the back section 18, and may cover the entire front section 16 or only some but not all of the front section 16, generally but not exclusively following the contour of the crown 12 at the top and sides.

A version of the ball cap 10 is disclosed in FIGS. 1-4. The ball cap 10 has a crown 12 that can be made of multiple panels and can be made of material such as fabric, although the crown 12 is not required to be made of the fabric and/or have multiple panels in other embodiments. The material making up the crown 12 may be cotton, wool, nylon, or other materials. Although not shown, the crown 12 may include a buckram that is located at the front of the crown 12 in order to provide structure and form to the crown 12. In other versions of the ball cap 10, no buckram is present in the crown 12. The brim 14 extends forward from the crown 12 in the longitudinal direction 20 of the ball cap 10. The longitudinal direction 20 is the direction extending between the back and front of the ball cap 10 as commonly worn by a wearer when having the brim 14 situated above the eyes of the wearer. The brim 14 is made of a material that is generally stiffer than the crown 12 and may be curved or angled in the lateral direction. The brim 14 may be made of a single panel or multiple panels, and may be slotted or perforated.

The crown 12 has a front section 16 and a back section 18 that are disposed from one another in the longitudinal direction 20. A button at the top of the crown 12 may demarcate the boundary between the sections 16, 18. The crown 12 can have a central axis 76 that extends through the center of the crown 12, and the front section 16 may be forward of the central axis 76 in the longitudinal direction 20, and the back section 18 may be rearward of the central axis 76 in the longitudinal direction 20. The front section 16 may extend 180 degrees about the central axis 76, and the back section 18 may extend 180 degrees about the central axis 76. In other embodiments, the sections 16 and 18 do not extend 180 degrees about the central axis 76 but instead extend some other magnitude of degrees. The front section 16 need not be the front half of the crown 12, but can simply be a portion of the crown 12 forward of the back section 18 in the longitudinal direction 20. The boundary line between the front half 16 and the back half 18 may be at the vertical top of the crown 12 which is the highpoint of the crown 12 in the vertical direction when worn. The brim 14 may engage the crown 12 at the front section 16 of the crown 12 and not the back section 18. The engagement of the crown 12 occurs at a location that is not at the brim base 84 of the crown 12. The engagement of the crown 12 is at the front section 16 spaced upward from the base 84 but not all the way to the midpoint of the crown 12 so that no engagement is at the back section 18. However, other embodiments exist in which the brim 14 does in fact extend to and is located at the central axis 76, and in which the brim 14 extends beyond the central axis 76 in the longitudinal direction 20 so that it engages and is located at the back section 18.

The brim 14 may be referred to as a "high brim" because its crown 12 engagement is not proximate to the base 84 but is instead high up on the crown 12 closer to the top of the crown 12. However, it is to be understood that the aforementioned description is directed to the center of the brim 14 as it is closer to the top of the crown 12 than to the base 84. The side edges of the brim 14 may curve downward or otherwise be disposed so that they in fact engage or are located at the base 84.

Although described as being the central axis 76 of the crown 12, the central axis 76 could be a central axis 76 of other portions of the ball cap 10 or the wearer of the ball cap 10. The central axis 76 may represent the center of the head of the wearer onto which the ball cap 10 is placed. Additionally or alternatively, the central axis 76 may be an axis of the sweatband 54 or the central axis of the part of the ball cap 10 that engages the wearer. The central axis 76 can represent the location that is farthest from the engagement with the wearer of the ball cap 10 at the very bottom of the ball cap 10. If the perimeter 72 is open in that the front of the head of the wearer does not engage anything, or if the perimeter 72 extends vertically upward due to again the front of the crown 12 if present being open, then the perimeter 72 and the central axis 76 can be defined by completing the perimeter at the lowest location of contact of the ball cap 10 and then putting the central axis 76 into the farthest position from the perimeter 72 created by the actual ball cap 10 portion and the imaginary line drawn for the perimeter 72. The central axis 76 need not be the central axis of a circular perimeter 72 because the lowest point of engagement of the ball cap 10 with the wearer will not always be circular but can be elliptical or otherwise elongated. As such, there is no requirement that the central axis 76 be associated with a completely circular perimeter 72, or other object or feature of the ball cap 10.

The brim 14 covers a portion of the top surface 22 of the front section 16. This portion that is covered is designated as a covered portion 32. The covered portion 32 is covered by the brim 14 such that the covered portion 32 would not be visible from a top view of the ball cap 10. The covered portion 32 would also not be visible from a side view of the ball cap 10. The remaining section of the front section 16 that is not covered by the brim 14 is designated as an uncovered portion 34. The brim 14 may be positioned so high up on the crown 12 that the covered portion 32 of the top surface 22 has a greater surface area than the area of the uncovered portion 34 of the top surface 22. In this manner, most of the area of the top surface 22 of the front section 16 is covered by the brim 14. In other versions of the ball cap 10, the brim 14 may completely cover the top surface 22 so that no uncovered portion 34 is present.

The back section 18 is uncovered by the brim 18 and is the rearward portion of the crown 12 in the longitudinal direction 20. In some instances the back section 18 is the back half of the crown 12, but the back section 18 need not be one half of the crown 12 but can be any portion of the crown 12 such as those greater than and less than one half of the crown 12. This is the same as the front section 16 which may be the front half of the crown 12, or may be a portion of the crown 12 greater or less than one half of the crown 12. The central axis 76 may extend through a button of the crown 12, if a button is present, but need not extend through the button as the button may not be at the center of the crown 12 in the radial direction 78. The crown 12 is shaped in a manner to be worn on the head 26 of the wearer of the ball cap 10. The crown 12 can be symmetrical about the central axis 76 so that the front section 16 and the back section 18 are symmetrical, although they may have different features and thus not be completely symmetrical with one another in certain embodiments. The head 26 of the wearer when wearing the ball cap 10 engages a bottom surface 24 of the front section 16, and a bottom surface 30 of the back section 18. When wearing the ball cap 10, the head 26 of the wearer does not engage the top surface 22 of the front section 16, and does not engage the top surface 28 of the back section 18. The crown 12 can be arranged to fit onto the head 26 of the wearer, and an equal area of the bottom surface 24 and the bottom surface 30 may engage the head 26.

Figure 4:
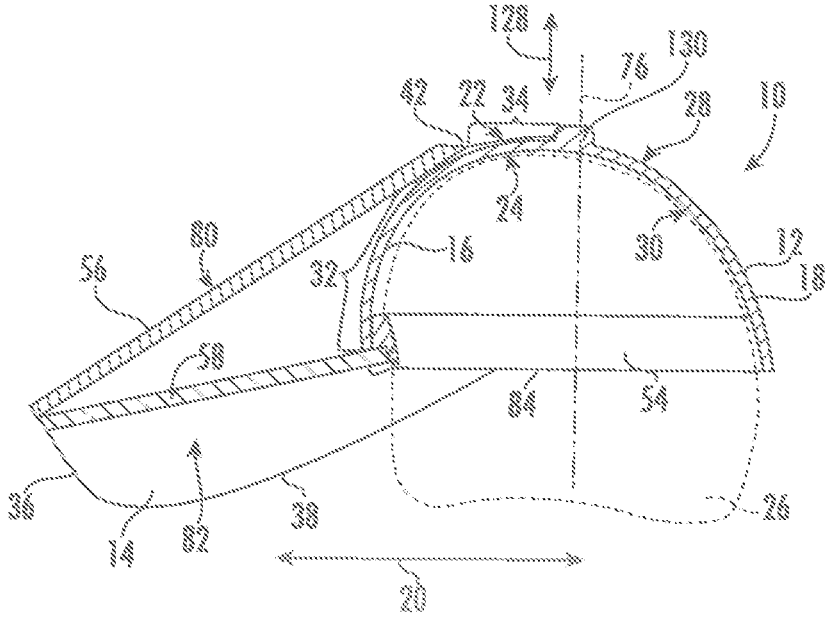
FIG. 4 is a cross-sectional view taken along line 4-4 of FIG. 3.

The brim 14 has an upper brim section 56 and a lower brim section 58, and in later embodiments can feature a support structure 114 that functions to support the brim 14 and connect it to another element such as the sweatband 54. The upper brim section 56 is the portion of the brim 14 that is located high on the crown 12 as previously discussed. The upper brim section 56 includes the tailing edge 42 of the brim 14 that is the portion of the brim 14 closest to the central axis 76 in the longitudinal direction 20. The upper brim section 56 extends at a particular angle from the front section 16 and has an upper surface 80 that forms the top of the brim 14. The upper brim section 56 may also extend at a non-zero angle to the central axis 76, the back section 18, or any combination of the front section 16, back section 18, and central axis 76. The lower brim section 58 is likewise attached to the front section 16 and extends forward of the crown 12 in the longitudinal direction 20. The lower brim section 58, or support structure 114 if present, may be attached to the base 84, or could be attached higher than the base 84 such as at some other point on the top surface 22. The lower brim section 58 may not include the tailing edge 42 of the brim 14 since the upper brim section 56 extends closer to the central axis 76 in the longitudinal direction 20 than the lower brim section 58. The lower brim section 58 may extend in the forward longitudinal direction 20 from the crown 12 at a different angle than the upper brim section 56. The covered portion 32 may be located between the upper brim section 56 and the lower brim section 58, or the support structure 114. The upper and lower brim sections 56, 58 may engage one another at their extent farthest from the crown 12 in the longitudinal direction 20. In the embodiment shown in FIGS. 1-4, however, the lower brim section 56 does not extend all the way to the leading edge 36 of the brim 14 and instead terminates short of the leading edge of the upper brim section 56 so that the upper brim section 56 extends a longer distance in the longitudinal direction 20 than the lower brim section 58. However, the sides of the lower brim section 58 extend to the sides of the upper brim section 56. The edges of the upper brim section 56 are curved upon extension into the leading edge 36. The brim sections 56, 58 merge with one another such that they are contacted along their sides towards the side edges 38, 40 of the brim 14. Alternatively, the only point of engagement may be at the tip of the brim 14 which forms the 36 of the brim 14. Although the lower surface 82 of the lower brim section 58 is shown as being visible in FIG. 4, it is to be understood that the upper brim section 56 could extend lower than the lower brim section 58 and be visible in a cross-sectional view as shown in FIG. 4.

The ball cap 10, and most ball caps in general, may include a sweatband 54. The sweatband 54 can encircle the entire crown 12 and may be located on the inside of the crown 12 and may engage the head 26 when worn. The sweatband 54 may function to catch sweat and prevent hair from falling out of the ball cap 10 and onto the wearer. The sweatband 54 may completely encircle the crown 12 so that it extends 360 degrees about the central axis 76 in a circumferential direction about the central axis 76. The sweatband 54 may be located the same distance from the central axis 76 in the radial direction 78 of the crown 12 at all points along the sweatband 54, or different portions of the sweatband 54 may be closer or farther from the central axis 76 in the radial direction 78 than other portions of the sweatband 54. The sweatband 54 may define a perimeter 72 that extends around the central axis 76 the full 360 degrees about the central axis 76 in the circumferential direction. The perimeter 72 in turn can define an opening 74 through which the head 26 of the wearer is inserted and removed when putting on the ball cap 10 and removing the ball cap 10. The perimeter 72 may extend upwards in the same direction that the central axis 76 extends. In this regard, the tailing edge 42 of the brim 14 can be located within the perimeter 72. The tailing edge 42 may thus be closer to the central axis 76 than portions of the sweatband 54 and perimeter 72 in the radial direction 78. Portions of the brim 14, and in particular portions of the upper brim section 56 can be located within the perimeter 72. These portions of the brim 14 can be located so that portions of the perimeter 72 are located farther forward from the central axis 76 in the longitudinal direction 20 than are those portions of the brim 14. The sweatband 54 can be provided with a manual adjustment mechanism for expanding and contracting the size of the perimeter 72 as needed in order to allow the head of the wearer to fit the ball cap 10. This manual adjustment mechanism of the sweatband 54 can be at any portion on the sweatband 54 such as constructed into the lower brim support to allow for a concealed fit adjustment that cannot be seen by a person when the ball cap 10 is worn.

With reference to FIG. 1, the high brim 14 feature of the ball cap 10 can be described with reference to different relative distances between points of the ball cap 10 in the vertical direction 128. The vertical direction 128 may be a distance parallel to the central axis 76, or can be the vertical direction relative to the ground when the wearer wears the ball cap 10. The vertical direction 128 is perpendicular to the longitudinal direction 20. A highest crown point 130 is the location of the crown 12 that is highest in the vertical direction 128, and the lowest crown point 132 is that point of the crown 12 that is lowest in the vertical direction 128, normally at the base 84. The highest brim point 134 is the point of the brim 14 that is highest in the vertical direction 128. These points are noted in FIG. 1 and in other side and cross-sectional views described herein. The distance 136 is the distance in the vertical direction 128 from the highest brim point 134 to the highest crown point 130, and the distance 138 is the distance in the vertical direction 128 from the highest brim point 134 to the lowest crown point 132. These points 132, 134, 136 need not all lie along the same line as one another so the distances 136, 138 can be measured by extending lines from the points 132, 134, 136. The distance 134 is less than the distance 138 which means that the highest brim point 134 is closer to the highest crown point 130 in the vertical direction than to the lowest crown point 132. This relative positioning means that brim 14 is a high brim in that it is closer to the top of the crown 12 in the vertical direction 128 than to the bottom of the crown 12. Aside from having positioning described in reference to just the vertical direction 128, the distances in some instances can be described as being absolute distances. In this regard, the distance from the highest brim point 134 to the highest crown point 130 is less than the distance from the highest brim point 134 to the lowest crown point 132. These distances can include components in the vertical direction 128, the radial direction 78 and/or the longitudinal direction 20. The other embodiments disclosed herein that have a crown 12 can have these relative distances as previously described and thus a repeat of this information is not necessary.

Figure 5:
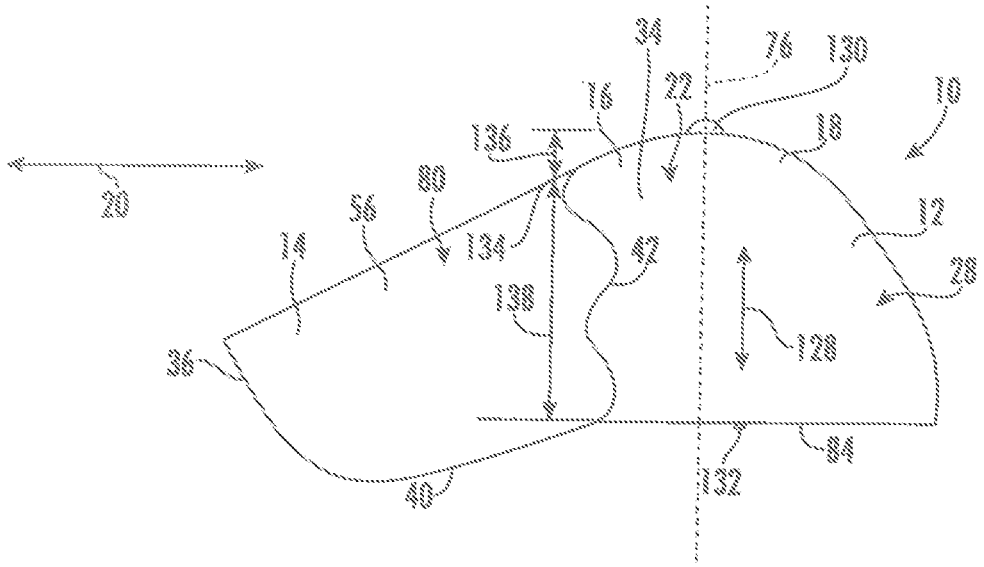
FIG. 5 is a side view of a ball cap with a straight side edge and a wavy tailing edge.
Figure 6:
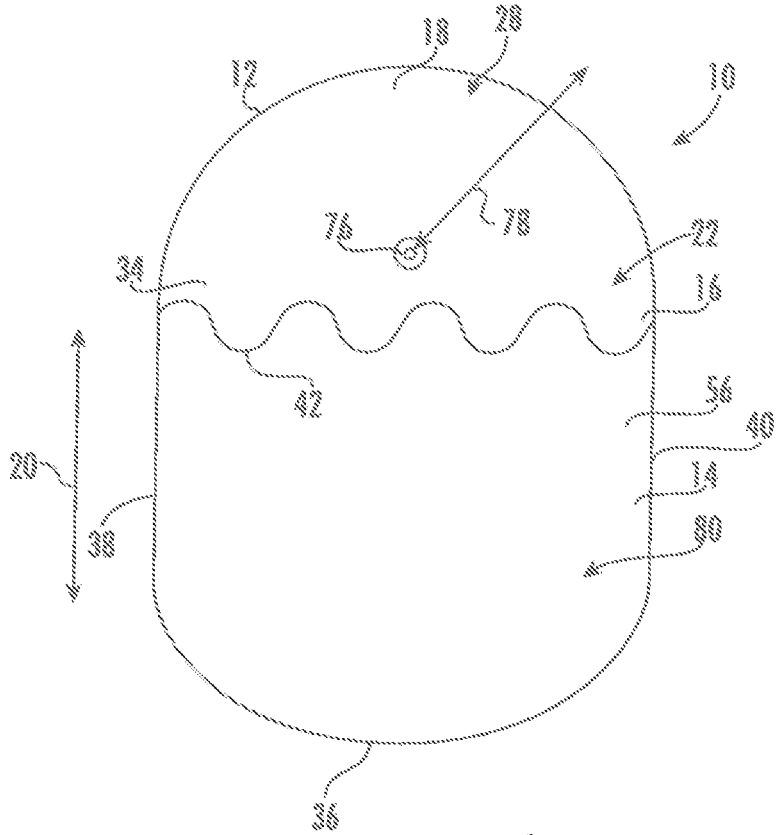
FIG. 6 is a top view of the ball cap of FIG. 5.

FIGS. 5 and 6 show an alternative exemplary embodiment of the ball cap 10. In this particular arrangement, the front section 16 is the front half of the crown 12, and the back section 18 is the back half of the crown 12. The brim 14 is again arranged so that the tailing edge 42 of the brim 14 is located in the front section 16 and does not extend to the back section 18 and is not located at the boundary of the front section 16 and back section 18 so that an uncovered portion 34 is present. The tailing edge 42 may extend from the side edges 38, 40 across the front section 16 in a wavy pattern. The tailing edge 42 is thus not linear in extension between the side edges 38, 40 as its distance increases and decreased from the central axis 76 in the longitudinal direction 20 upon extension between the side edges 38, 40. The wavy pattern may be sinusoidal in shape. Alternatively, the wavy pattern may have a zigzag shape, may have a curvy shape, may have an angular shape, may be wavy and symmetrical, or may be wavy and non-symmetrical in accordance with various exemplary embodiments. The aforementioned wavy pattern may help to better connect the brim 14 to the crown 12 and may achieve a unique look to the ball cap 10. In other versions, the tailing edge 42 is not wavy, but is instead linear in shape between the side edges 38, 40, or the tailing edge 42 exhibits some degree of curvature but is less than wavy between the side edges 38, 40.

The ball cap 10 also has a straight brim 14 in that the side edges 38 and 40 are arranged at a ninety degree angle to the leading edge 36 of the brim 14. In the side view shown in FIG. 5, the leading edge 36 is oriented at a right angle to the side edge 40. Although not shown, the leading edge 36 is likewise oriented at a right angle to the side edge 38. The transition between the leading edge 36 and the side edges 38, 40 may be a sharp right angle, or there could be some slight rounding of this corner. In the embodiment in FIGS. 5 and 6, the transition is rounded so that a round shape is present between the leading edge 36 and both side edges 38, 40. It is generally the case that this transition is rounded and even substantially rounded in most of the ball caps 10. The brim 14 may also be arranged so that the leading edge 36 extends in a lateral direction to the side edges 38, 40 such that the side edges 38, 40 are not angled. With reference to FIG. 6, the side edges 38, 40 extend completely in the longitudinal direction 20 and do not extend in the lateral direction, which is the direction perpendicular to the longitudinal direction 20. The side edges 38 and 40 are parallel to one another upon their extension in the longitudinal direction 20 from the tailing edge 42 to the leading edge 36. However, it is to be understood that in other arrangements of the ball cap 10 that the side edges 38 and 40 could be angled to one another and may be non-parallel. The side edges 38 and 40 may approach one another upon their extension in the longitudinal direction 20 away from the crown 12, or the side edges 38 and 40 may extend away from one another upon their extension away from the crown 12 in the longitudinal direction 20. The rounded transition between the side edges 38 and 40 and the leading edge 36 can be thought of as a portion of the leading edge 36 so that the side edges 38, 40 are not angled or rounded in the illustrated embodiment.

The upper surface of the brim 14 can have a flat upper surface 80 that extends all the way from the leading edge 36 to the tailing edge 42 so that it is continuous and uniform between these two edges 36, 42. The flat upper surface 80 may not have an indentation or other feature that causes the upper surface 80 to dip down or rise up upon its extension from edge 36 to edge 42. When not constructed with the upper brim section 56 and the lower brim section 58, the top surface of the brim 14 may still be flat and continuous from the leading edge 36 to the tailing edge 42 as discussed. The brim 14 can extend lower than the base 84 of the crown 12 so that the bottom of the brim 14 and the bottom of the base 84 are not straight relative to one another but are instead angled as shown in FIG. 5.

Figure 7:
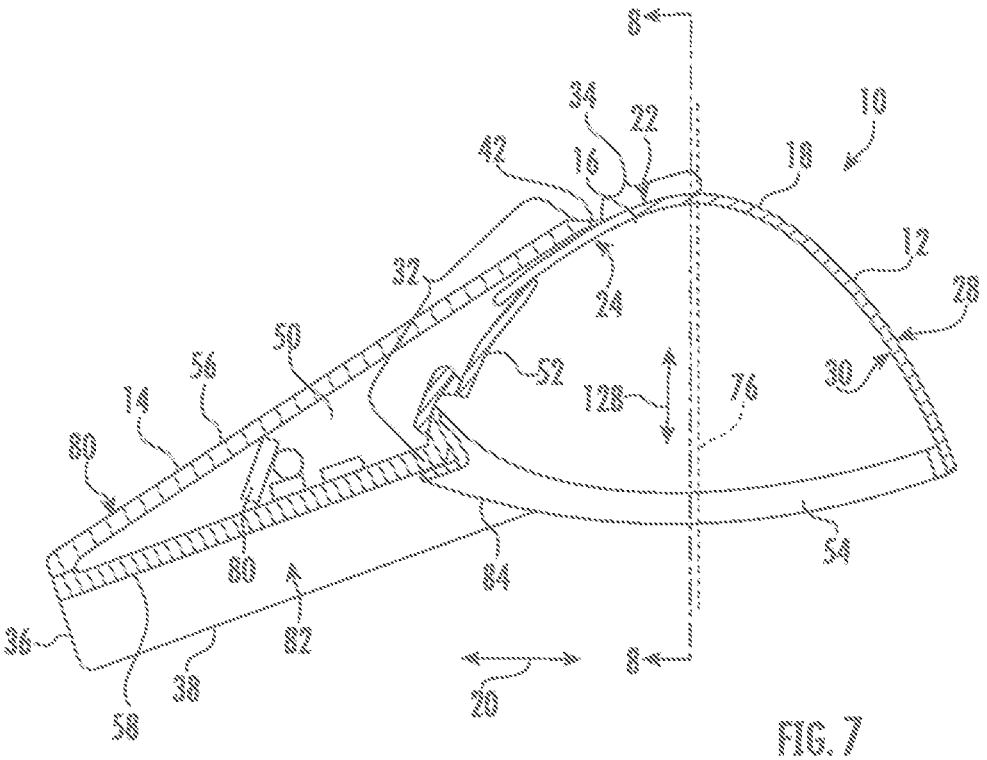
FIG. 7 is a side cross-sectional view of a ball cap with a storage pocket.
Figure 8:
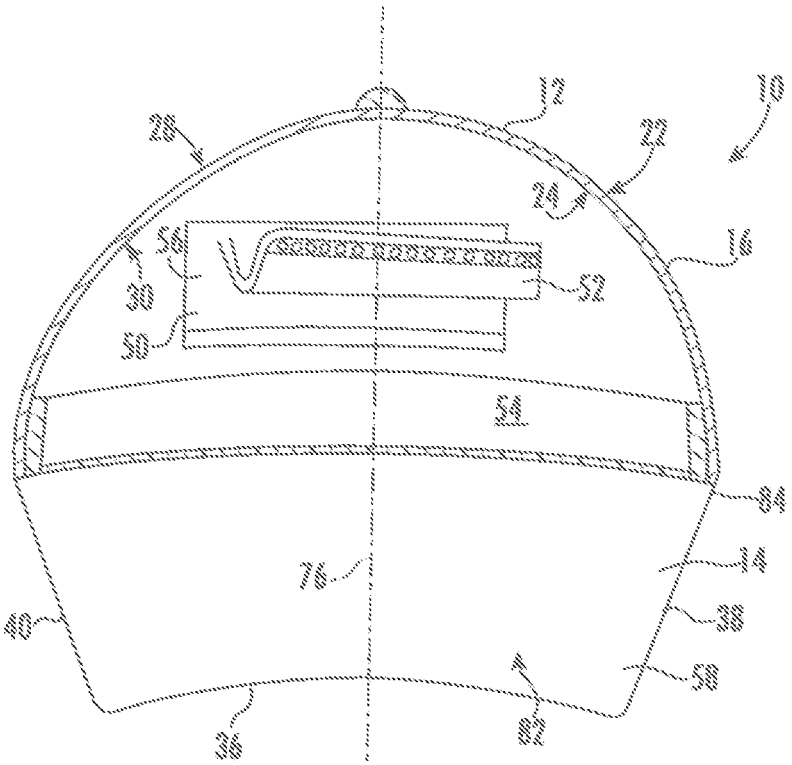
FIG. 8 is a cross-sectional view taken along line 8-8 of FIG. 7.

FIGS. 7 and 8 show an alternative exemplary embodiment of the ball cap 10 in which a storage pocket 50, which can be described as a compartment, is present for the hiding or storage of objects 86. The brim 14 may be constructed with an upper brim section 56 and a lower brim section 58, and the tailing edge 42 of the brim 14 at the upper brim section 56 may be located high on the crown 12 at the front section 16. The front section 16 may define an opening that can be selectively opened and closed by an access door 52, which can be described as a flap. The access door 52 could be closed or opened with the use of a hook and loop type fastener, buttons, snaps, clasps, or simply by being tucked into a receiving pocket or into the sweatband 54. The access door 52 may have a hook and loop fastener located at its lower edge, upper edge, or side to affect attachment to and removal from the bottom surface 24. The top of the access door 52 may be permanently attached to the front section 16 at the bottom surface 24. The access door 52 is shown open in FIG. 8 and is shown closed in FIG. 7. The access door 52 and the opening in the front section 16 can be spaced from the base 84 and the tailing edge 42 so that it is completely spaced from and does not engage either of these two features of the ball cap 10. Although described as having an access door 52, the ball cap 10 need not have an access door 52 in other embodiments and can be arranged so that the opening to the storage pocket 50 is open at all times and not capable of being closed.

The storage pocket 50 may be defined by the top surface 22, the bottom surface of the upper brim section 56, the upper surface of the lower brim section 58, and the access door 52. Additional walls or features may be located within the sections 56 and 58 in order to further define the storage pocket 50. The storage pocket 50 may thus be located completely forward from the top surface 22 of the front section 16 in the longitudinal direction 20.

Figure 9:
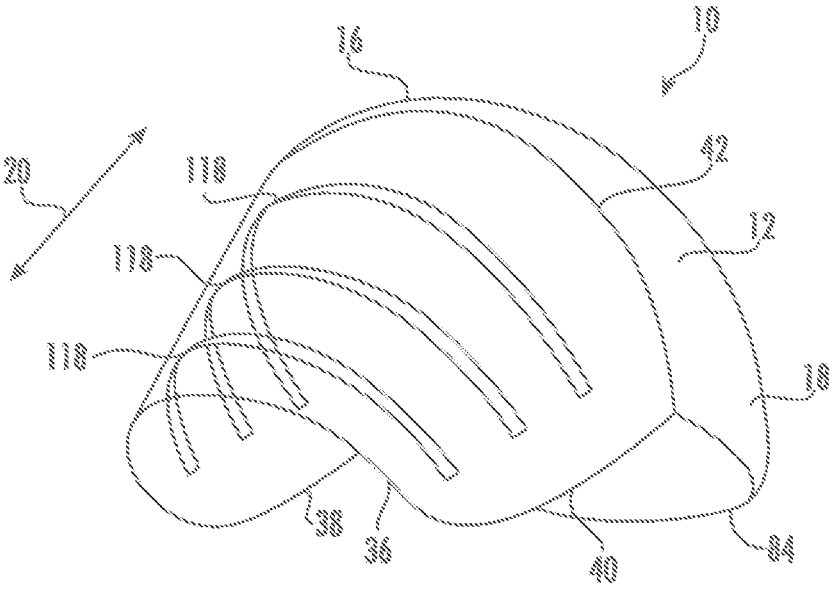
FIG. 9 is a perspective view of a hat with brim curvature retention ribs.

FIG. 9 is a perspective view of a ball cap 10 that has a series of brim curvature retention ribs 118 located on the brim 14 that function to stiffen the brim 14 so that it retains a desired curvature and shape. The brim curvature retention ribs 118 can be of any number on the brim 14 and may be on the upper surface of the brim 14, inside of the material of the brim 14, or on the lower surface of the brim 14. When an upper brim section 56 and lower brim section 58 are present, the brim curvature retention ribs 118 can be on any surface or inside of either or both of these sections 56, 58. The brim curvature retention ribs 118 extend in the direction from the side edge 38 to the side edge 40 but do not extend all the way to the side edges 38 and 40, although in other embodiments they might. When multiple brim curvature retention ribs 118 are present, they may be spaced from one another in the longitudinal direction 20 as shown in FIG. 9. The brim curvature retention ribs 118 can be more rigid than other portions of the brim 14, or may have the same rigidity as the material making up the brim 14. Their presence, and potentially the material making them up, functions to increase the stiffness of the brim 14 and keep it in a desired shape. However, the brim curvature retention ribs 118 need not be so stiff that they cannot flex or allow the brim 14 itself to experience some degree of flexing. As with other features of the ball cap 10, the brim curvature retention ribs 118 can be incorporated into any of the other disclosed embodiments so that this feature can be used in many other versions of the ball cap 10.

Figure 10:
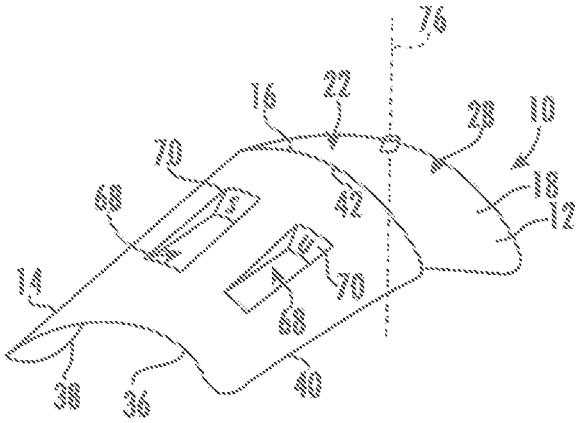
FIG. 10 is a perspective view of a ball cap with a pair of indicia depressions.
Figure 11:
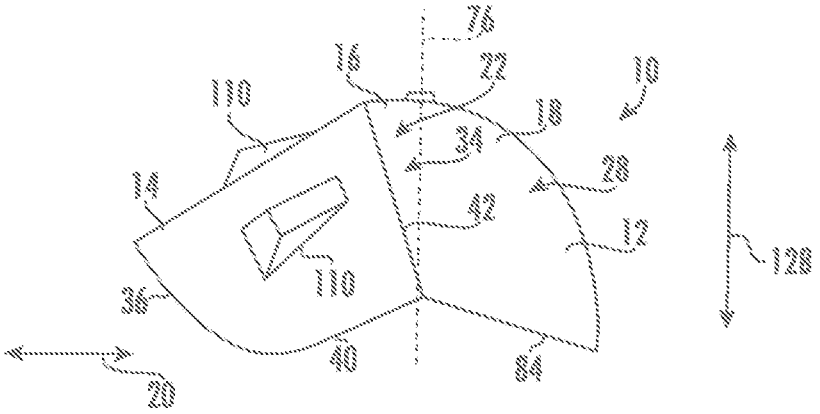
FIG. 11 is a side view of a ball cap with protrusions extending from the brim.

FIG. 10 shows another embodiment of the ball cap 10 in which the brim 14 is again a high brim 14 on the front section 16. The brim 14 features a pair of indicia depressions 68 in the upper surface of the brim 14. The brim 14 is shown having a single portion, but it is to be understood that the brim 14 could in other arrangements have the upper brim section 56 and the lower brim section 58. The indicia depressions 68 have a back wall that is generally at a right angle to the upper surface of the brim 14. A second wall extends from this back wall to the top surface of the brim 14. Indicia 70 is present on the back wall of the indicia depression 68 such that the indicia 70 is located below the top surface of the brim 14. There can be any number of indicia depressions 68 present on the brim 14. For example, 1, 3, 4, from 5-10, or up to 20 indicia depressions 68 may be included on the brim 14. The indicia 70 can be any writing or graphics. Although described as being within the indicia depressions 68, it is to be understood that other indicia may be located on the ball cap 10 as well at other areas of the ball cap 10 such as on the top surface of the brim 14, and on the front section 16 and on the back section 18. Further, the indicia 70 if present can also be located on any other portion of the indicia depressions 68 in addition to or alternatively to those portions shown in FIG. 10. Also, the shape of the indicia depressions 68 can be varied in other embodiments so that they are concave in shape, triangular, or any other shape. As such, the indicia depressions 68 may be of any shape or size. Other embodiments are possible in which the depressions in the brim 14 do not have indicia located therein. FIG. 11 shows another embodiment in which instead of depressions, a three protrusions 110 are present on the brim 14 and extend above the surface of the brim 14. However, in the side view of FIG. 11 only two of the three protrusions 110 are visible. The protrusions 110 are on the upper surface and sides of the upper brim section 56 when an upper brim section 56 is present in these embodiments. The protrusions 110 may also provide an aesthetic compliment to the high brim 14 look of the ball cap 10. Indicia may or may not be present on the protrusions 110. Aside from providing an aesthetically 3D augmentation of the letters, text or graphics, the protrusions 110 and/or the indicia depressions 68 may provide additional utility for the mounting of electronic devices or for ventilation.

Figure 12:
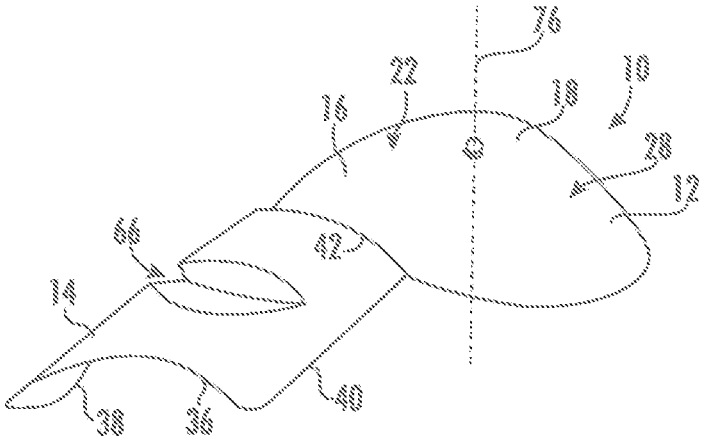
FIG. 12 is a perspective view of a ball cap with a sunglass depression.
Figure 13:
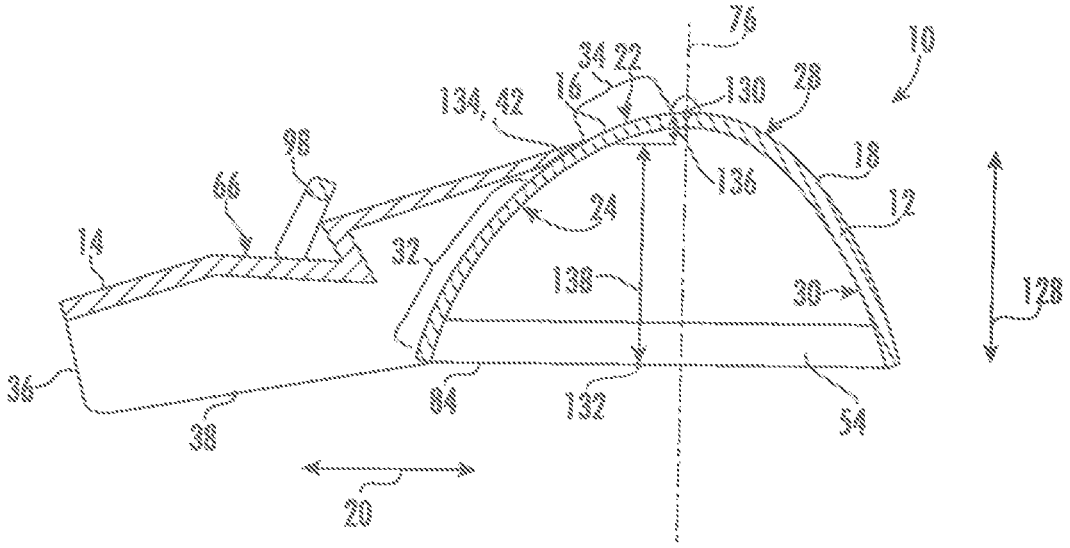
FIG. 13 is a cross-sectional view of the ball cap of FIG. 12.

FIGS. 12 and 13 disclose an exemplary embodiment of the ball cap 10 that features a sunglass depression 66 for holding a pair of sunglasses 98. The sunglass depression 66 is located in the brim 14 at the top surface of the brim 14. Although the brim 14 is but a single piece in FIGS. 12 and 13, it may include the upper and lower brim sections 56 and 58 as previously mentioned, and in these embodiments the sunglass depression 66 may be located at the top surface of the upper brim section 56. The sunglass depression 66 is a discontinuity in the upper surface of the brim 14 such that the brim 14 is not a single continuous plane between the leading edge 36 and the tailing edge 42. The sunglass depression 66 may be located completely within the brim 14 so that no portion of the sunglass depression 66 engages the side edges 38, 40 or engages the leading edge 36 or the tailing edge 42. The sunglass depression 66 is a depression within the brim 14 that receives a pair of sunglasses 98 to allow the sunglasses 98 to rest onto the brim 14 and the ball cap 10 as the stems of the sunglasses 98 may engage the crown 12 or other portions of the brim 14. The sunglass depression 66 may dip down into the brim 14 and then emerge so that the top surface of the brim 14 is even on either side of the sunglass depression 66. The sunglass depression 66 may extend any amount in the circumferential direction about the central axis 76.

Figure 14:
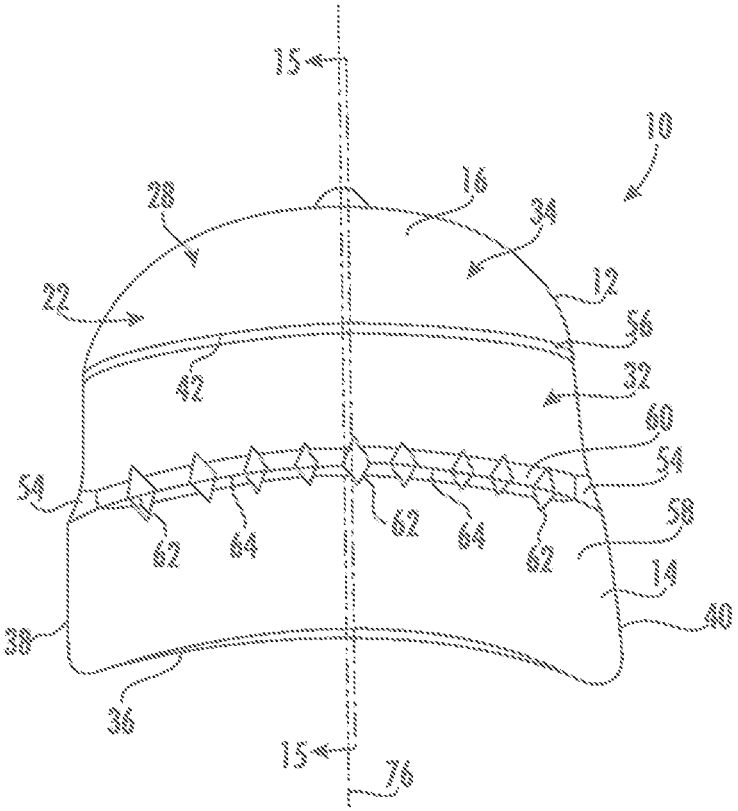
FIG. 14 is a front view of a ball cap with a lower brim section support with most of the upper brim section removed for clarity.
Figure 15:
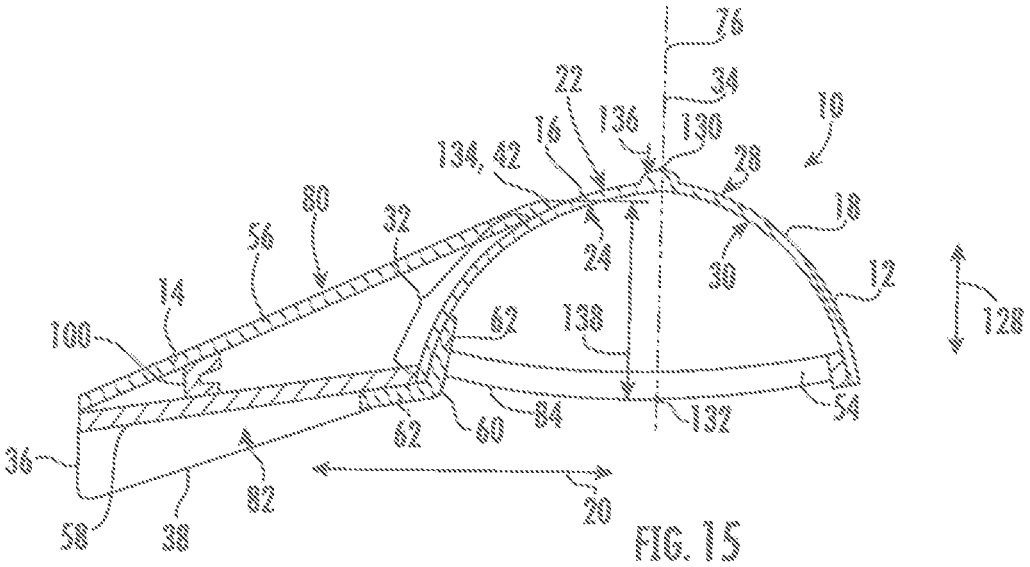
FIG. 15 is a cross-sectional view taken along line 15-15 of FIG. 14.

Another version of the ball cap 10 is shown in FIGS. 14 and 15 in which the ball cap 10 is stretchable in order to accommodate different size heads 26. It is known to provide an adjustable mechanism on the back section 18 of the crown 12, at the sweatband 54, that allows the size of the crown 12 to be adjusted. In the embodiments disclosed, the sweatband 54 may be stretchable. A stretchable sweatband 54 allows the crown 12 to increase or decrease in size as necessary to allow for a desired fit. This stretching is generally in the radial direction 78 to allow the crown 12 to expand in the radial direction 78 and to contract in the radial direction 78 when necessary. A lower brim section support 60 may be present to allow for stretching of the front portion of the sweatband 54. The lower brim section support 60 may be thought of as a portion of the sweatband 54 or may be thought of as a separate component from the sweatband 54.

The lower brim section support 60 has a plurality of stretchable segments 62 disposed between a series of support segments 64. The stretchable segments 62 may have more stretch than the support segments 64. Further, the stretchable segments 62 may be capable of stretching more than the fabric/material of the front section 16 and the brim 14. The stretchable segments 62 are connected to both the brim 14 and to the front section 16. Although shown as connected to the bottom surface 24, the stretchable segments 62 may alternatively be connected to the top surface 22 in other exemplary embodiments. Further, although shown as being diamond in shape, the stretchable segments 62 may be variously shaped and do not have to be shaped the same way as one another in various exemplary embodiments. The ends of the sweatband 54 are attached to the support segments 64. The support segments 64 are not rigidly attached to both the brim 14 and the front section 16 because if that were the case then the front section 16 could not adjust relative to the brim 14. The lower brim section support 60 may thus expand and contract as necessary in order to increase or decrease the size in the radial direction 78. The lower brim section support 60 may be a portion of the sweatband 54, and may not be a portion of the sweatband 54 in various embodiments. The entire sweatband 54 360 degrees about the central axis 76 may all be capable of expanding and contracting in the radial direction 78 about the central axis 76. In other versions less than 360 degrees may expand or contract. For instance, if the attachment of the brim 14 about the forward portion of the crown 12, or if the lower brim section support 60 is not stretchable, then the sweatband 54 may expand and contract but not all the way around the central axis 76. The sweatband 54 may be capable of stretching up to 330 degrees, up to 320 degrees, up to 300 degrees, or up to 270 degrees about the central axis 76, and the areas of stretch may be the portions of the sweatband 54 that are most rearward in the longitudinal direction 20. However, in other embodiments the only stretchable area of the ball cap's 10 entire sweatband 54 is the lower brim section support 60.

With reference to FIG. 15, a support piece 100 is located between and engages both the upper brim section 56 and the lower brim section 58 to provide support for properly spacing these components and to help create a desired shape/look of the brim 14. In embodiments in which a storage pocket 50 is present, the support piece 100 can function as a deterrent to keep stored objects from getting wedged in the forward most "V" area between the upper brim section 56 and the lower brim section 58.

Figure 16:
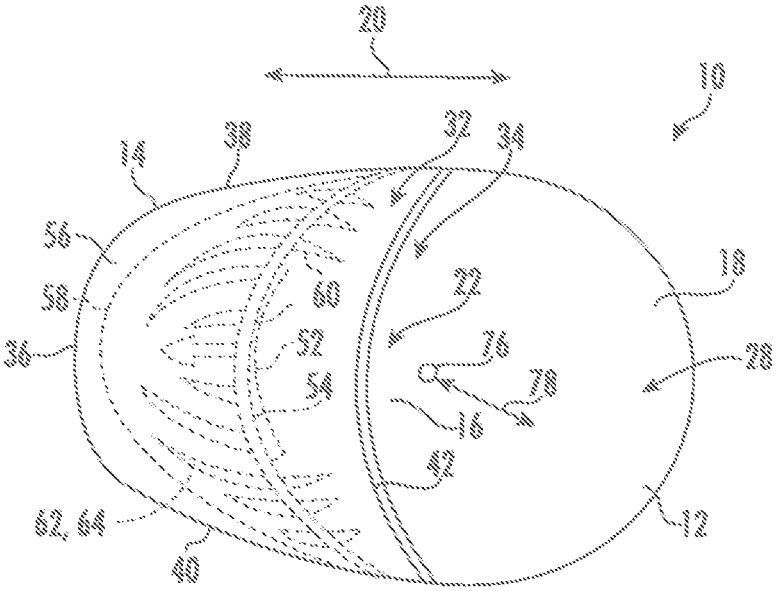
FIG. 16 is a top view of a ball cap with an alternate lower brim section support.

Another version of the ball cap 10 with the lower brim section support 60 is illustrated with reference to FIG. 16. The lower brim section support 60 includes a series of segments 62, 64 that extend in generally the longitudinal direction 20 with some but a lesser extension in the radial direction 78. The segments 62, 64 provide both a support functionality of the lower brim section 58 and also provide stretching functionality of the crown 12 and/or sweatband 54 in order to accommodate different sized heads 26. The segments 62, 64 may be molded segments and can be made of a plastic, fabric, or any component that is firm yet exhibits some degree of stretching. The segments 62, 64 can be arranged so that the indicated dashed-line areas in FIG. 16 are cut-out areas of the lower brim section 58 that are filled with stretchable material in them, or cover them to allow for stretching of the lower brim section 58 as described. As such, the components 62, 64 instead of providing distinct functionally of stretching or supporting, as in the FIGS. 14 and 15 versions, can provide both of these functions. The sweatband 54 may also be a stretchable component and be included with the elements 62, 64. The stretchable segments 62, 64 can be more rigid than material making up the brim 14, and can be more rigid than the material making up the upper brim section 56 and the lower brim section 58 if both of these sections 56, 58 are present. The components 62, 64 have a curvature along their extension in the longitudinal direction 20 and are disposed along the front section of the sweatband 54. The components 62, 64 may engage the lower brim section 58, the crown 12, and the sweatband 54, and can be free from engagement with the upper brim section 56.

The components 62, 64 can be of any number and can have different shapes and configurations in other embodiments. In some instances, the components 62, 64 do not have the curvature exhibited in FIG. 16 but instead are more linear in shape upon their extension from the front section 16 to the lower brim section 58. In other versions, the components 62, 64 may extend generally in the circumferential direction across the lower brim section 58 at different distances from the central axis 76. These components 62, 64 can be engaged with one another at the sweatband 54 on the left and right hand sides of the sweatband 54, and at the left and right hand sides of the lower brim section 58. The components 62, 64 may also be present on the crown 12 and the sweatband 54 in order to provide flexibility or expansion and contraction to the crown 12, and their positioning here is not like as described on the lower brim section 58 but is instead only at the center front portion of the front section 16 and does not extend to the left and right sides of the crown 12 or sweatband 54.

Other embodiments of the lower brim support structure 60 exist in which the structure 60 is constructed of a pliable, padded, semi-solid or gel-infused material that allows conformity while retaining much of its shape and structure.

Figure 17:
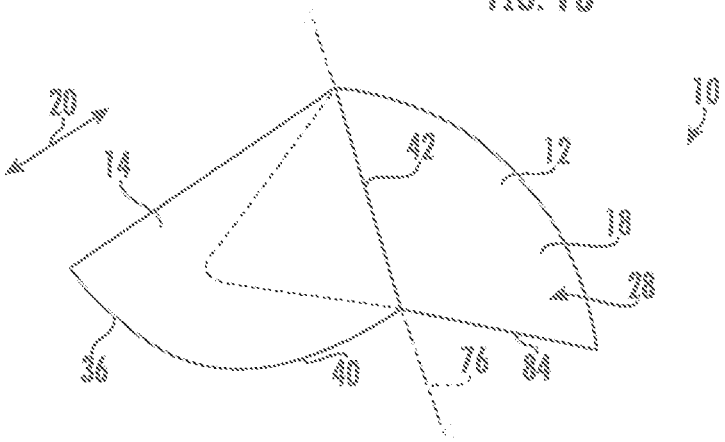
FIG. 17 is a side view of a ball cap with the brim located at the central axis covering the front section of the crown completely but covering no portion of the back section.

The brim 14 may extend over a portion of the front section 16, and in some embodiments may extend across the entire front section 16. FIG. 17 shows a version of the ball cap 10 in which the brim 14 extends up to the central axis 76 in the longitudinal direction 20. The brim 14 covers the entire front section 16, but does not cover any of the back section 18. In this regard, the brim 14 covers all of the top surface 22 of the front section 16, but the brim does not cover any portion of the top surface 28 of the back section 18. In this particular embodiment, the front section 16 is the front half of the crown 12, and the back section 18 is the back half of the crown 12. In other embodiments, the front and back sections 16, 18 are not exactly halves of the crown 12 but instead one section 16, 18 is more than a half and the other section 16, 18 is less than a half. The brim 14 terminates right at the boundary between the front section 16 and the back section 18 such that it terminates at the central axis 76 and covers one half of the crown 12 and leaves one half of the crown 12 uncovered. As discussed here, coverage of the crown 12, such as the front section 16 the back section 18 or any other portion of the crown 12, relates to the calculated surface area of the crown 12. The surface area may be calculated as a hemisphere or portion of a hemisphere as the crown 12 may have these shapes. For example, if a majority of the front section 16 is described as covered, this means that more surface area of the front section 16 is covered and a lesser amount of the surface area of the first half 16 is uncovered. It is to be understood as used herein that coverage of a component refers to coverage of the surface area of the component. If a top surface is discussed, the calculated area is that of the top surface, and the bottom surface of the component is not included in the calculation.

The tailing edge 42 represents a seam, and this seam may be located at the central axis 76 so that the seam, tailing edge 42 is not located at the back section 18 and does not cover any of the back section 18. The brim 14 may include the upper and lower brim sections 56, 58, or may not include these sections 56, 58 but instead may be just a single section without the upper and lower 56, 58 portions. Unless expressly disclosed and discussed, it is to be understood that the embodiments disclosed may or may not include the upper and lower brim sections 56, 58 and variations of the ball cap 10 exist in which the brim 14 is and is not made out of these two sections 56, 58. Although the present description may not state this with respect to all embodiments in which the sections 56, 58 are not expressly disclosed, it is to be understood that the brim 14 can be made of one section or more than one section and a repeat of this information is not necessary upon describing all embodiments. Some portions of the crown 12 that are hidden by the brim 14 are shown with dashed lines in FIG. 17. The base 84 of the crown 12 has a bottom surface that is all in the same plane such that the bottom surface of the base 84 extends 360 degrees around the opening into which the head of the wearer extends. The side edges 38, 40 have bottom edges that are in the same plane as one another, but are not in the same plane as the leading edge 36 which is greatly curved in the FIG. 17 embodiment. As such, the bottom surfaces of the brim 14 are all in the same plane, and the bottom surface of the crown 12 is all in the same plane although not the same plane as that of the bottom surfaces of the brim 14.

Figure 18:
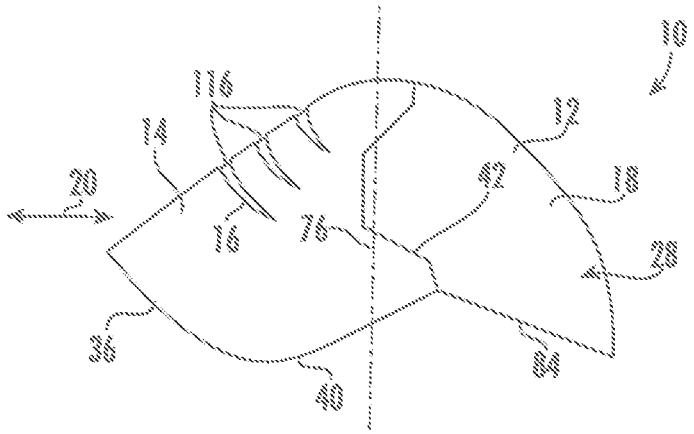
FIG. 18 is a side view of a ball cap with the brim covering some but not all of the back section of the crown and all of the front section of the crown with the central axis in the brim.

Another variant of the ball cap 10 is shown with reference to FIG. 18 in which the brim 14 extends over the crown 12 so as to cover at least a portion of the back section 18 as well. The brim 14 completely covers the top surface 22 of the front section 16 and covers the top surface 28 of the back section 18 but does not cover a majority of the top surface 28 of the back section 18. The central axis 76 is located within the brim 14 as well, and the tailing edge 42 and its seam are located in the back section 18. In other embodiments, the brim 14 covers both the entire front section 16 and the entire back section 18. In yet other arrangements, the brim 14 covers a portion of the back section 18 but not all of the back section 18, and may cover all or only some of the front section 16. In these versions, a cut out 116 or other non-covered area may be present at the front section 16 so that one or more portions of the front section 16 may be exposed and uncovered by the brim 14. These cut outs 116 may be defined at least partially by the tailing edge 42, or can be completely contained within the brim 14 so that the tailing edge 42 does not define any portion of the cut out 116. One, two, or three or any other number of cut outs 116 can be present. The cut outs 116 could be centered about the front midpoint of the crown 12 and may extend only partially to, but not all of the way to, the left and right sides of the crown 12. The cut outs 116, if more than one are present, can be spaced from one another in the longitudinal direction 20 and may not engage one another. The cut outs 116 may provide functionality in allowing the brim 14 and crown 12 to stretch somewhat to accommodate the top and side of the head 26 as they may allow for the brim 14 to likewise flex some degree. Although FIG. 18 shows the ball cap 10 having cut outs 116, it is to be understood that other embodiments exist in which the cut outs 116 are not present and the ball cap 10 is arranged as shown in FIG. 18 with the exception that the cut outs 116 are removed. The cut outs 116 may or may not extend to a brim 14/crown 12 seam. In FIG. 18 the cut outs 116 do in fact extend to the seam at which the brim 14 meets the crown 12. However, in other embodiments the cut outs 116 do not extend this far and in fact are located completely within the brim 14.

In various embodiments, the brim 14 may cover all of the front section 16 and none of the back section 18, some but not all of the front section 16 and none of the back section 18, some but not all of the front and back sections 16, 18, or all of the front section 16 and some of the back section 18. The distinction between the front and back sections 16, 18 may be the boundary line defined by the central axis 76 so the front section 16 is forward of the central axis 76 in the longitudinal direction 20, and the back section 18 rearward of the central axis 76 in the longitudinal direction 20. In other embodiments, the back section 18 is forward of the central axis 76 in the longitudinal direction 20, and the front section 16 is likewise rearward of the central axis 76 in the longitudinal direction 76.

Figure 19:
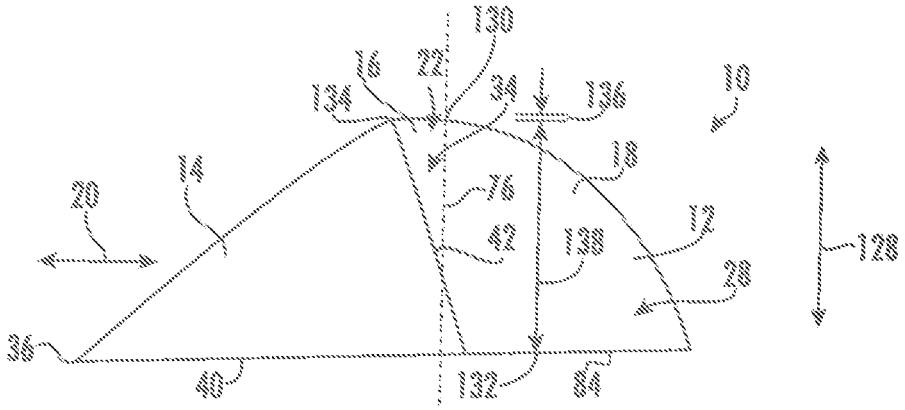
FIG. 19 is a side view of a ball cap with the base of the crown and the sides and front of the brim in the same plane.

As with the FIG. 17 embodiment, the bottom surface of the crown 12, which is the bottom surface of the base 84, is all in the same plane upon its extension around the opening into which the head of the wearer extends. The bottom of the side edges 38, 40 are also all in the same plane, the curvature of the leading edge 36 not being a bottom surface of the brim 14. The plane into which the bottom of the brim 14 is located is a different plane than that of the plane into which the bottom of the crown 12 is located. FIG. 19 is an embodiment of the ball cap 10 in which the bottom surface of the base 84 of the crown 12 and the bottom surfaces of the side edges 38, 40 lie in the same plane as one another. The brim 14 is also configured so that the bottom surface of the leading edge 36 likewise lies in the same common plane as that of the bottom surfaces of the leading edges 36, 40 and the base 84. In effect, the bottom surface of the entire brim 14 and the bottom surface of the entire crown 12 are all in the same plane as one another. No portions of the bottoms of the side edges 38, 40 are higher or lower than the bottom surface of the base 84. Although the leading edge 36 is straight in FIG. 19, it can be curved in other embodiments upon its transition from the side edges 38, 40, as shown for example with reference back to FIG. 18. However, in these arrangements the side edges 38, 40 are still all in the same plane as base 84. The curvature is that of the leading edge 36 and is not that of the side edges 38, 40. The curvature may cause the bottom of the leading edge 36 to be located above the plane into which the side edges 38, 40 and the base 84 lie. In other exemplary embodiments, the side edges 38, 40 need not be in the same plane as the base 84, for example the embodiments previously discussed in FIGS. 17 and 18.

The summit may be the portion of the ball cap 10 that is highest in the vertical direction when the ball cap 10 is located upright but not placed onto the head of the wearer. The summit can be located in the crown 12, in the brim 14, and at the crown 12/brim 14 intersection. In FIG. 17 the summit is located at the intersection of the brim 14 and crown 12. In FIG. 18 the summit is located in the brim 14. In FIG. 19 the summit is located in the crown 12. The central axis 76 may extend through the summit area of the ball cap 10. The tailing edge 42 may be at various locations on the ball cap 10 and can be angled or curved at various inclinations with respect to the aforementioned elements of the ball cap 10.

Figure 20:
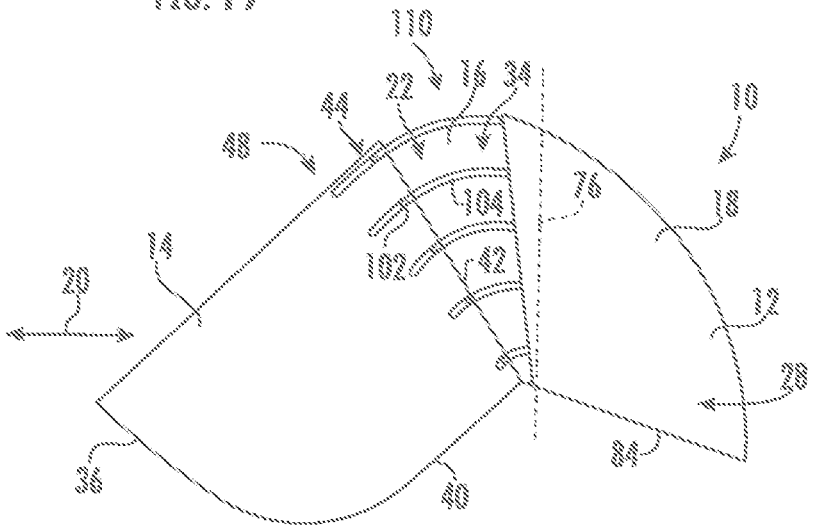
FIG. 20 is a side view of a ball cap with brim adjustment mechanism made of pins and slots.

A version of the brim adjustment mechanism 44 is shown with reference to FIG. 20. The brim 14 is in the second position 48 in which it is as far away from the central axis 76 as possible and in which the maximum amount of the uncovered portion 34 is exposed. The brim adjustment mechanism 44 has a plurality of pins 102 in the brim 14, each pin 102 disposed within a complimentary slot 104 in the front section 16 of the crown 12. The pins 102 are retained tightly within the slot 104 so that they do not move unless a sufficient force is applied to the brim 14 or crown 12 to achieve relative movement. If the brim 14 is moved along the slots 104 more of the uncovered portion 34 will become covered until the brim 14 moves the full length back into the first position 46 and the maximum amount of the crown 12 becomes covered. The brim adjustment mechanism 44 does not stretch upon a larger head 26 being put into the ball cap 10. Its adjustment does not make the perimeter 72 or size of the volume for the head 26 larger or smaller. The pins 102 and slots 104 are shown on the left side of the ball cap 10 in FIG. 20, but they can be present as well on the right side and may be symmetrically disposed about the midline of the ball cap 10. Although described as being on the brim 14, the pins 102 could instead be on the crown 12, and the slots 104 in the brim 14 in other versions of the brim adjustment mechanism 44.

Figure 21:
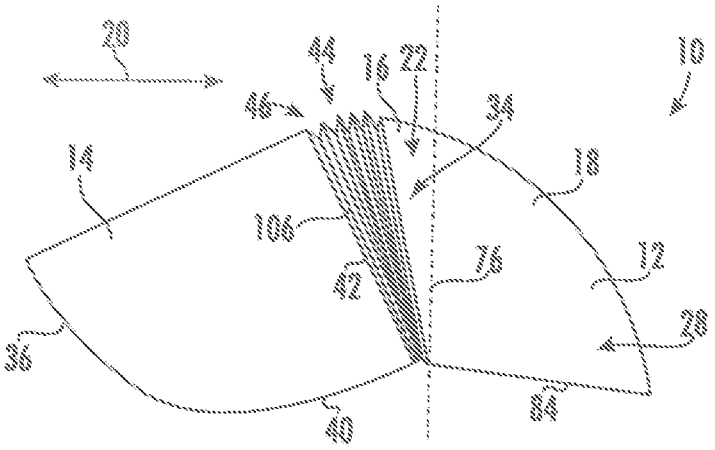
FIG. 21 is a side view of a ball cap with a brim adjustment mechanism made of a bellows style member.
Figure 22:
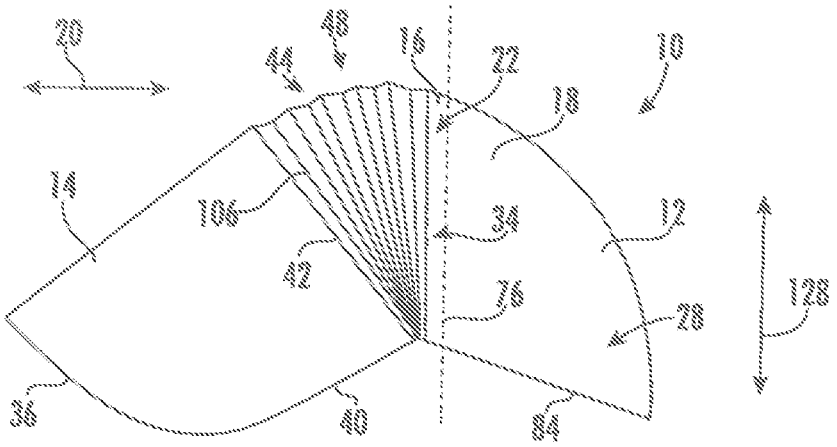
FIG. 22 is a side view of the ball cap of FIG. 21 with the bellows style member extended outward the fullest extent.

The ball cap 10 with another version of the brim adjustment mechanism 44 is illustrated in FIG. 21 and includes a bellows member 106. The brim 14 is in the first position 46 and is as close as possible to the central axis 76. The bellows member 106 covers a portion of the crown 12 in the first position 46. In some embodiments, the bellows member 106 itself forms a portion of the crown 12 and does not cover any of the crown 12. The bellows member 106 may be made out of plastic, or fabric, or any other type of material capable of adjustment. The bellows member 106 can be expanded from its completely collapsed first position 46 to the completely expanded second position 48 shown in FIG. 22. Each segment of the bellows member 106 can be popped out into an expanded state to achieve the second position 48. The segments of the bellows member 106 are rigid enough so that they maintain their collapsed or expanded state unless the user applies sufficient force to them to cause them to move.

In the second position 48, the bellows member 106 covers a greater portion of the top surface 22 of the front section 16 of the crown 12 than when in the first position 46. If the crown 12 is not present under the bellows member 106, then it will cover a greater portion of the head 26 of the user when in the second position 48. The brim 14 is angled more forward in the longitudinal direction 20 in the second position 48, and may be positioned further below the plane the base 84 lays in when the bellows member 106 is fully expanded. The bellows member 106 is attached to and engages the tailing edge 42 and this attachment can be through any mechanisms such as mechanical fasteners, integral formation, ultrasonic welding, hook and loop fasteners, or stitching. If present, the bellows member 106 could be attached to the upper brim section 56 and not the lower brim section 58 so that when the bellows member 106 expands, it moves relative to the lower brim section 58. The central axis 76 can be located some distance from the bellows member 106 such that the bellows member 106 is only located in the front section 16 and a portion of the front section 16 is always exposed even in the first position 46. In other embodiments, the central axis 76 extends through the bellows member 106.

Figure 23:
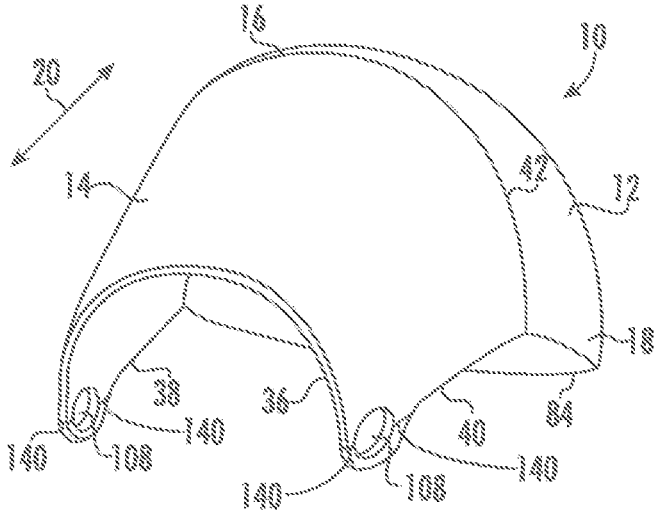
FIG. 23 is a perspective view of a ball cap with apertures extending below the bottom most edges of the brim.
Figure 24:
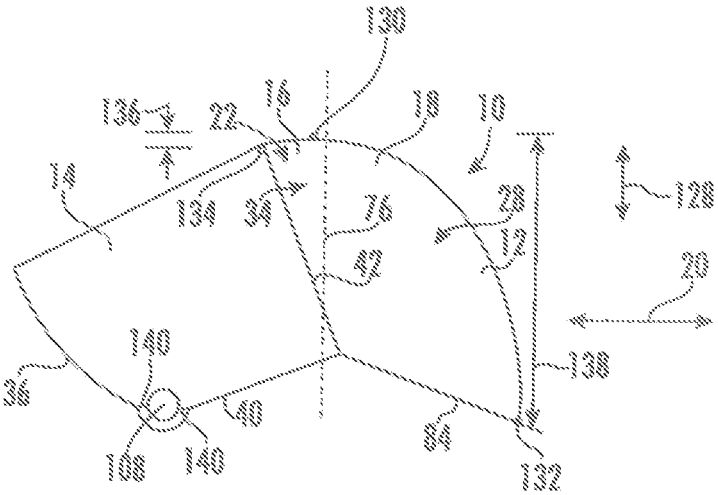
FIG. 24 is a side view of the ball cap of FIG. 23.

Another version of the ball cap 10 is shown with reference to FIGS. 23 and 24. The brim 14 is curved in shape such that the leading edge 36 is likewise curved. The side edges 38, 40 may be straight and the other elements can be as previously discussed with respect to other embodiments. The brim 14, and in particular the upper brim section 56 if it is present, has a pair of apertures 108 that are through apertures. They are circular and are the same size as one another. A user may hook sunglasses 98 onto one or both of the apertures 108 to hold them onto the ball cap 10 instead of wearing them on his or her face. Other items can be suspended by use of the apertures 108 such as key rings, glasses or pens. Yet other items can be displayed through use of the apertures 108 such as jewelry, ornaments or novelty items. In other embodiments, additional apertures 108 can be present so that four or six apertures 108 are defined through the brim 14. In still other embodiments, the apertures 108 are not circular but are instead differently shaped. In some arrangements, the apertures 108 have four sides in which two opposite sides are curved and in which two opposite sides are straight. The apertures 108 can be the same shape and size when on both sides of the brim 14, or may different in shape and size when two of them are present on opposite sides of the brim 14. Any number of apertures 108 can be present and their location need not be the upper brim section 56. One or more apertures 108 could be located in the lower brim section 58 or in the crown 12. The apertures 108 can be set up so that they are each the same distance from the leading edge 36. One of the apertures 108 can be closer to the side edge 38 than the other aperture 108. In turn, the other aperture 108 is closer to the side edge 40 than the first aperture 108. The apertures 108 are positioned so that they are in effect "lower" than the side edges 38 and 40 so that protrusions are below the straighter portions of the side edges 38, 40 to accommodate their presence. Alternatively, the apertures 108 can be higher up on the brim 14 so that they are above the side edges 38, 40 so that protrusions as shown in FIGS. 23 and 24 are not present. The apertures 108 may vary in size, shape and placement, and may be symmetrical or asymmetrical in size, shape, and/or placement. The brim 14 can have a single aperture 108 on one side only, may have two apertures 108 on opposite sides as shown in the figures, or may have multiple apertures 108 above, at, or below the brim edges 38, 40 or even below the leading edge 38 through the use of the illustrated protrusions. The limits of the leading edge 36 and the side edge 40 are denoted by the lines 140 and it can be seen that the aperture 108 is below the lines 140 and hence below the leading edge 36 and the side edges 38, 40 in the vertical direction 128. The aperture 108 may be completely or partially below the edges 36, 38, 40 in accordance with various exemplary embodiments.

Figure 25:
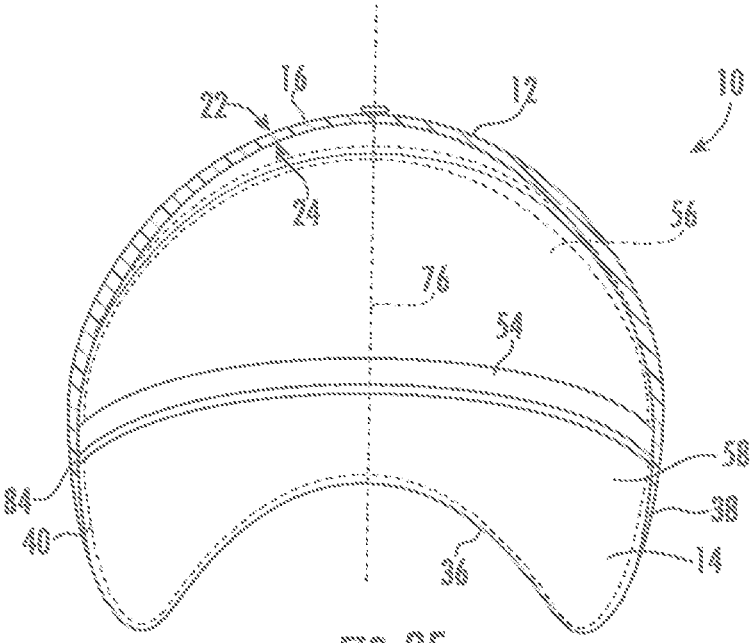
FIG. 25 is a cross-sectional view of the ball cap in accordance with yet another exemplary embodiment that shows the inside of the front portion of the ball cap.

FIG. 25 is a cross-sectional view of the ball cap 10 taken through the central axis 76 and looking forward. The view in FIG. 25 compliments other views of the ball cap 10, such as the one shown in FIGS. 1-4, and shows the relationship between various elements of the ball cap 10 such as the top surface 22, bottom surface 24, sweatband 54, upper brim section 56 and lower brim section 58. The brim 14 is curved as the leading edge 36 has a concave portion located between a pair of convex portions. These convex and concave portions can be present in the upper brim section 56, and in some instances may be in the lower brim section 58 as well. The brim 14 may feature various types of curvatures, angles and shapes and can be curved along its entire surface or only along a portion of its surface.

Figure 26:
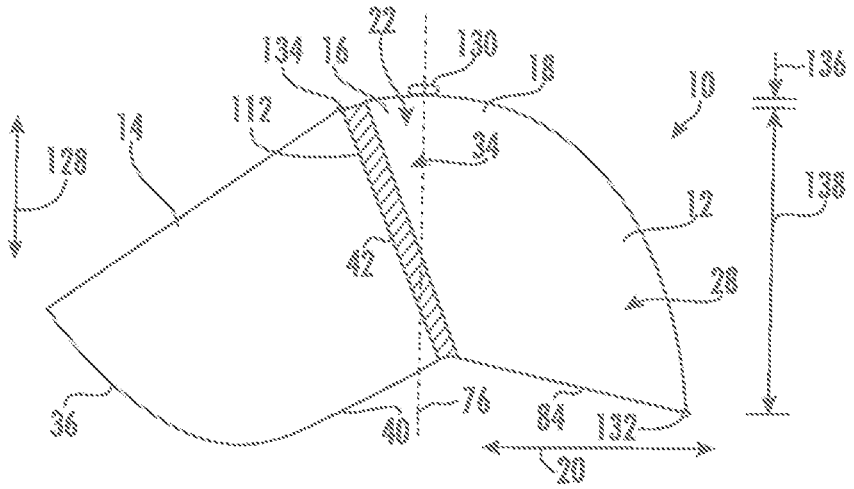
FIG. 26 is a side view of the ball cap with a stretchable segment at or incorporated into a brim/crown seam.

FIG. 26 shows an embodiment of the ball cap 10 that has a stretchable segment 112 that allows the ball cap 10 to expand to accommodate various head 26 sizes of different wearers. The stretchable segment 112 differs from the brim adjustment mechanism 44 in that it is not per se adjustable by the wearer but instead expands based upon the size of the head 26 of the wearer and contracts once the head 26 is removed. The stretchable segment 112 is made out of a material that is capable of stretching and can retain its initial, pre-stretched shape when force from the head 26 is removed. In other embodiments, the stretchable segment 112 does not regain its original non-stretched shape, but instead expands when the head 26 is inserted and keeps the stretched shape even when the head 26 is removed. The stretchable segment 112 can be the most stretchable portion of the ball cap 10, and may be more stretchable than any other part of the ball cap 10 such as the crown 12 and brim 14.

The stretchable segment 112 can be located over the crown 12 so that a portion of the crown 12, such as the front section 16 is covered by the stretchable segment 112. Alternatively, the stretchable segment 112 itself forms part of the crown 12 and does not cover any of the crown 12. At least a portion of the stretchable segment 112 is uncovered by the crown 12. The stretchable segment 112 may be attached to the tailing edge 42 of the brim 14. If an upper brim section 56 is present, the stretchable segment 112 engages the upper brim section 56. If a lower brim section 58 is present, the stretchable segment 112 can be arranged so that it may in some instances engage the lower brim section 58, and in other versions may not engage the lower brim section 58. Upon placing the head 26 into the ball cap 10, the front portion of the crown 12 moves forward in the longitudinal direction 20 which causes the stretchable segment 112 to stretch and move forward in the longitudinal direction 20 as well. The front and back portions of the crown 12 may themselves not be stretchable absent the stretchable segment 112. The sweatband 56 is present and may or may not be stretchable. The stretchable segment 112 may in effect cut the other portions of the ball cap 10 in two so that they are divided into a front and back sections 16, 18 and are not engaged with one another so that none of the elements making up the front section 16 and the back section 18 themselves stretch. The brim 14 may change its angular position relative to the back section 18 when the ball cap 10 is stretched. Stretching does not cause any additional crown 12 surface area to be exposed. The stretchable segment 112 may be a strip as shown in FIG. 26 that extends from the left hand side of the ball cap 10 to the right hand side so that it is essentially a rectangular piece of material that is curved about the contour of the ball cap 10 and is connected on one end to the brim 14 and the other to the crown 12 with no other sections present. The stretchable segment 112 may also be of other sizes and shapes such as curvy or triangle, wider at the base 84 on both sides and narrowing to a point at the top of the ball cap 10 or vice versa. In other embodiments, the stretchable segment 112 includes portions not visible in FIG. 26 and below the brim 14 and/or the crown 12.

Figure 27:
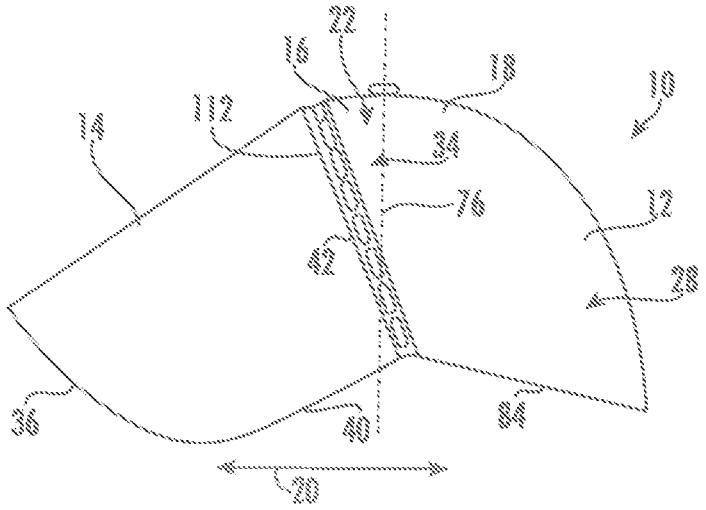
FIG. 27 is a side view of the ball cap with a widened or augmented brim/crown seam (gap) that has vent holes.

The size and shape of the stretchable segment 112 may be varied in accordance with various exemplary embodiments. FIG. 27 shows a stretchable segment 112 with a series of through holes that result in a ventilated seam gap region to be defined in the ball cap 10. The holes may all be of the same size, or may be of multiple sizes and shapes in other embodiments. Any number of holes may be present, and they can all be of the same size and shape or may have different sizes and shapes. The holes can be arranged so that they each have two straight edges that are connected by curved ends, or they may be circular holes in other versions. The holes provide ventilation to the ball cap 10 when worn and may be through holes in that the head of the wearer is directly exposed through the holes of the stretchable segment 112. The stretchable segment 112 can have a consistent length in the longitudinal direction 20 along its entire width, or may have areas that are longer in the longitudinal direction 20 and areas that are shorter in the longitudinal direction. Further, upon stretching the stretchable segment 112 may stretch different amounts in its width direction and need to stretch the same amount along its entire width. Although the stretchable segment 112 is shown, in another version of the ball cap 10, the stretchable segment 112 is not stretchable but a segment similar to it is present in the ball cap 10 with the ventilation holes. In these instances, the ball cap 10 may look like that shown in FIG. 27 except for the fact that segment 112 is not a stretchable segment.

Another feature of the ball cap 10 is the inclusion of one or more seams into the brim 14. The seams are not the seam of the tailing edge 42 but are in addition to this feature if the tailing edge 42 seam is in fact present. The seam could extend from the tailing edge 42 to the leading edge 36 and may divide the brim 14 into a left half and a right half. The seam may be wider at the leading edge 36 than at the tailing edge 42, or reversed or with variance within the seam and/or from seam to seam. The brim 14 may be divided into thirds or quarters in various embodiments by the seams. The seams may be offset to one side such as two fifths of the way up on the brim 14 from one side of the brim 14. Any number of seams may be present, such as one seam, two, three, or up to twenty seams. The seams can have any size or shape and all of them need not be of the same size and shape as one another. In this regard, they may differ from one another so that no two seems are arranged the same way. Alternatively, the shape of all of the seams can be the same as one another in other embodiments. Although described as being present in the brim 14, the crown 12 may also have the seams as previously mention in addition to having them be in the brim, or the seams may be in the crown 12 only and not in the brim 14.

Figure 28:
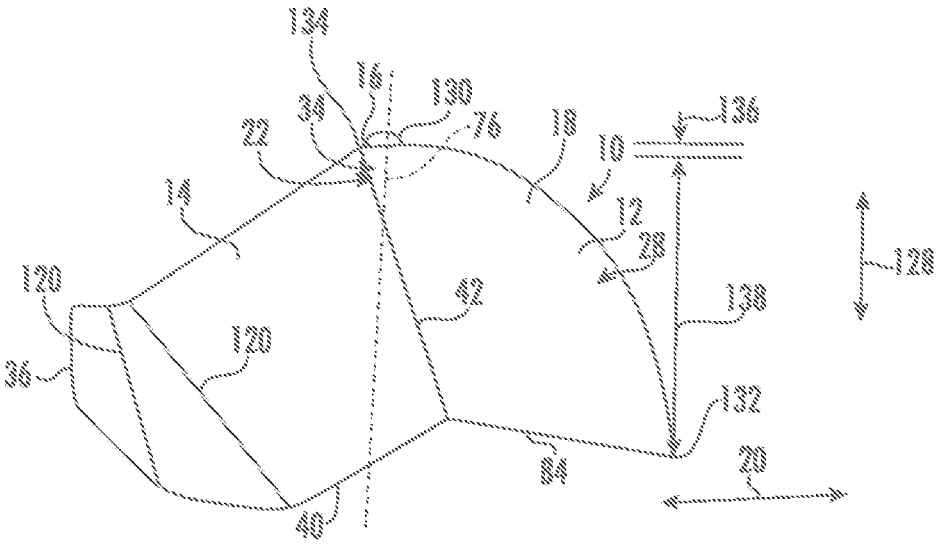
FIG. 28 is a side view of the ball cap that has brim incurvation.
Figure 29:
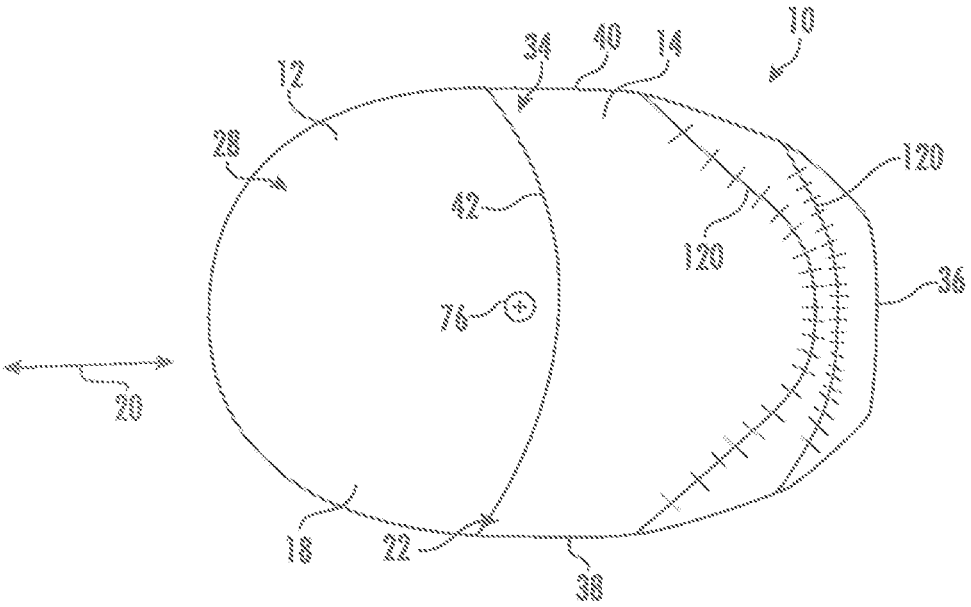
FIG. 29 is a top view of the ball cap of FIG. 28.

Another embodiment of the ball cap 10 is shown in FIGS. 28 and 29 that can be arranged as any of the other embodiments herein. This particular ball cap 10 includes an additional feature which is a pair of incurvations 120 in the brim 14. Although two are present, any number can be present in other embodiments such as one, three, four, five to ten, or up to twenty. The incurvation 120 is an inward curve of the brim 14 so that the upper surface of the brim 14 upon extending from the trailing edge 42 to the leading edge 36 changes angles so that it does not extend downward in the same angle upon reaching the more radially inward incurvation 120. At this point, the brim 14 extends towards the leading edge 36 at its modified angle until reaching the second incurvation 120 which is the one closest to the leading edge 36. The upper surface of the brim 14 will again change angle at this second incurvation and maintain this orientation until reaching the leading edge 36.

The incurvation 120 is a generally lateral incurvation, lateral meaning it is at a right angle to the longitudinal direction 20, in the brim 14 contour that is more pronounced at the brim's lateral center than at the side edges 38, 40. The incurvation 120 extends in the generally lateral direction on each side of the brim 14. When the pair of incurvations 120 are present as in FIGS. 28 and 29, the incurvations 120 may remain extant, although diminishing in depth as they simultaneously widen into a delta. After this portion the brim 14 top surface diminishes completely before reaching the brim's outer/lower edges 36, 40 on each side. The incurvations 120 are generally toward the front of the brim 14 and may be closer to the leading edge 36 than to the tailing edge 42. The brim 14 lower side edges 38, 40 on each side may be angled or curved to reflect the incurvation 120 termination. The incurvation 120 may be curved inward such that it is a concave curve, or angled in that the brim 14 has two flat surfaces, although curved about the longitudinal direction, that engage one another at the incurvation 120 junction point.

Figure 30:
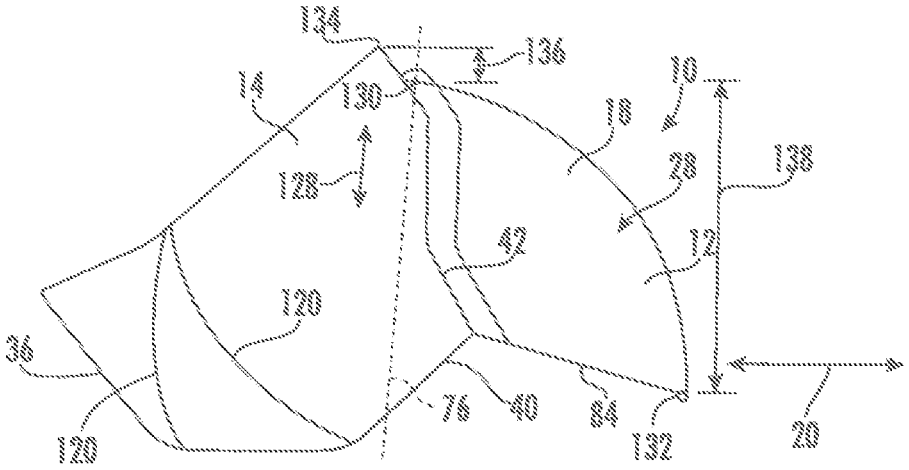
FIG. 30 is a side view of the ball cap with an elevated brim that has brim incurvation.
Figure 31:
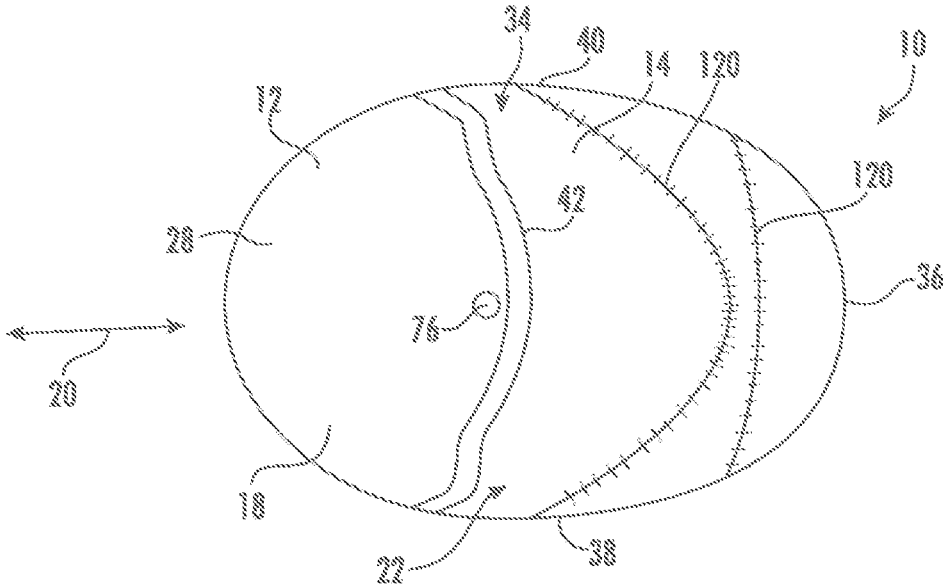
FIG. 31 is a top view of the ball cap of FIG. 30.

The incurvation 120 causes the brim 14 to not have the same, consistent shape from the leading edge 36 to the tailing edge 42. Another embodiment is shown in FIGS. 30 and 31 in which again a pair of incurvations 120 are present in the brim 14. The incurvations 120 are closer to the leading edge 36 of the brim 14 than to the tailing edge 42. The incurvations 120 can be arranged in a similar manner as previously discussed and cause the brim 14 to have a unique shape that can result in a better shield from sun exposure or wind. The brim 14 has a high tailing edge 14 that rests above the top surfaces 22 and 28 of the crown 12 such that it forms a gap at the top of the ball cap 10 between the tailing edge 42 and the crown 12.

Figure 32:
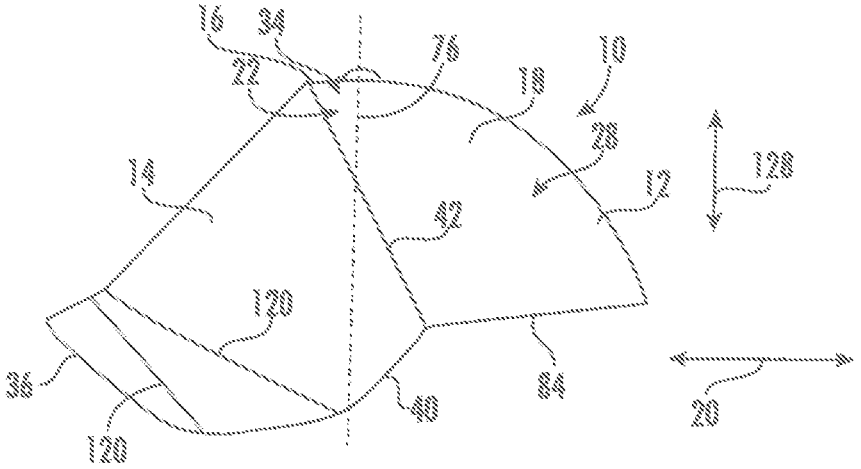
FIG. 32 is a side view of the ball cap with brim incurvation in accordance with another exemplary embodiment.
Figure 33:
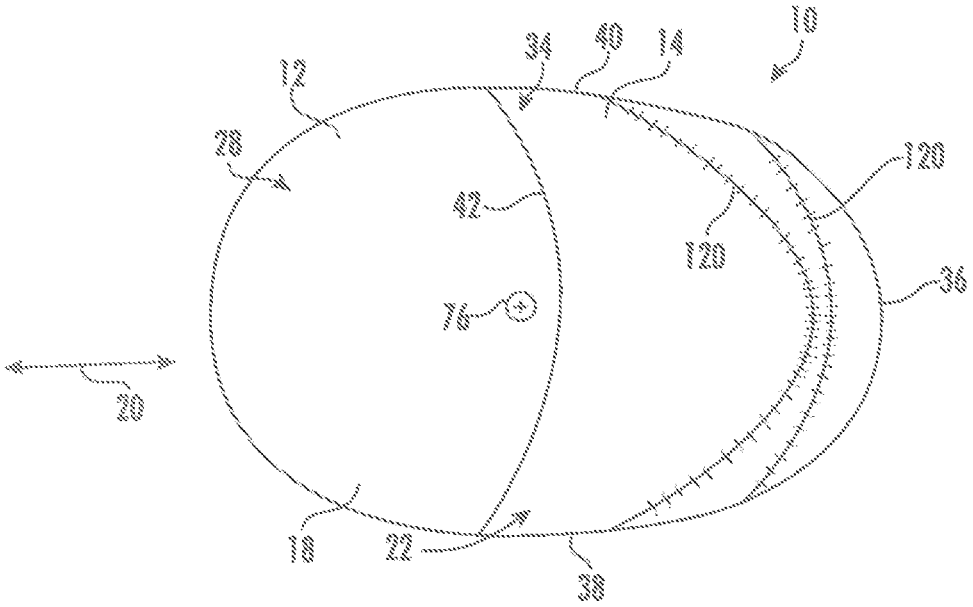
FIG. 33 is a top view of the ball cap of FIG. 32.

Another version of the ball cap 10 with incurvations 120 is in FIGS. 32 and 33 that is similar to the FIGS. 28 and 29 version. Here, the brim 14 covers most of the front section 16 but not all of the front section 16 so that an uncovered portion 34 is present, and the tailing edge 42 of the brim 14 extends rearward of the central axis 76 in the longitudinal direction 20. The incurvations 120 are arranged so that the shape of the brim 14 is different than that shown in FIGS. 28 and 29. In this regard, the leading edge 36 in FIG. 32 creates three edges while the side edges 38, 40 each create one edge. In the FIG. 28 embodiment, the incurvations 120 cause the leading edge 36 to create five distinct edges while the side edges 38, 40 again each create one edge. The incurvations 120 can be variously arranged in other embodiments allowing the brim 14 to achieve different looks having a top surface that is not consistently rising from front to back but rather rising at different rates and along some sections even not rising or lowering as per the configuration of the inclination 120 or inclinations 120.

Figure 34:
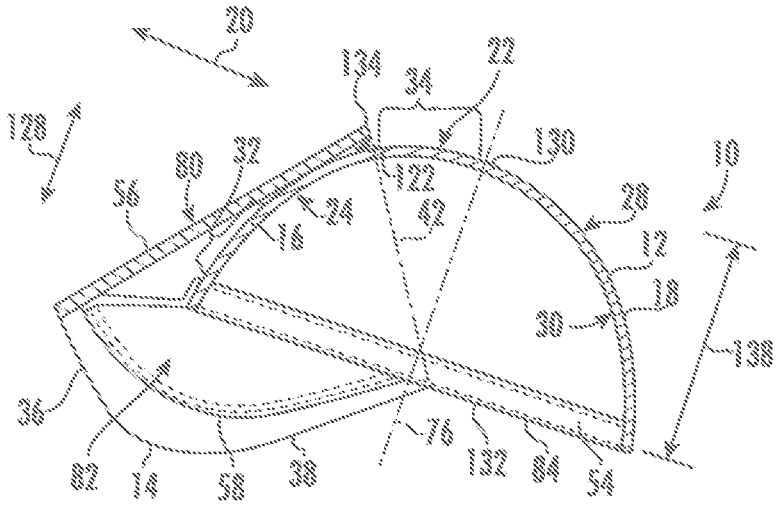
FIG. 34 is a cross-sectional view of a ball cap with an open gap between the brim and the crown.
Figure 35:
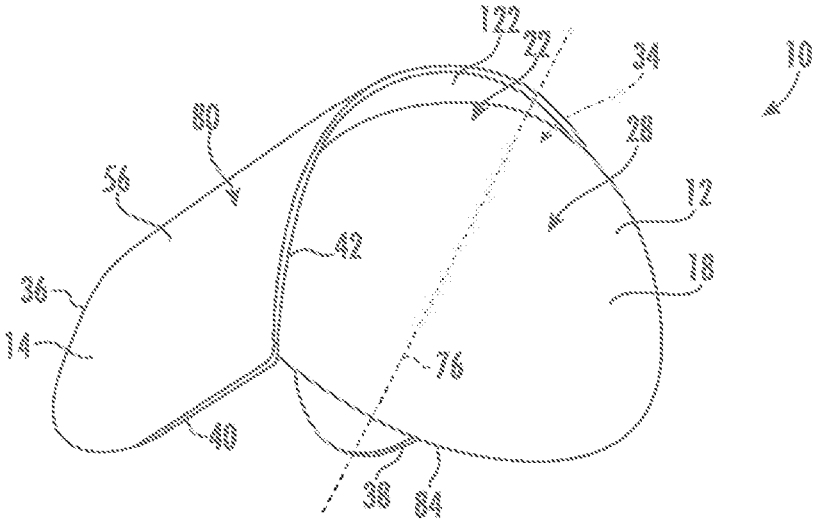
FIG. 35 is a back perspective view of the ball cap of FIG. 34.

Another embodiment of the ball cap 10 is shown in FIGS. 34 and 35 in which the brim 14 extends up and over the crown 12 so as to terminate at a location above the crown 12 forming an open gap 122 between the brim 14 and the crown 12. The ball cap 10 has a brim 14 that includes both an upper brim section 56 and a lower brim section 58 as in previous embodiments, and a sweatband 54 as previously described that completely circles the central axis 76 an entire 360 degrees around. The upper brim section 56 of the brim 14 extends over a portion of the front section 16 to form a covered portion 32 and terminates at the tailing edge 42. The tailing edge 42 is primarily at the front section 16 with a small amount at the back section 18 that is proximate to the sweatband 54. The termination of the tailing edge 42 above the top surface 22 causes an open gap 122 to be formed between the top surface 22, at the front section 16, and the upper brim section 56 of the brim 14. This open gap 122 may be configured so that an opening extends all the way from the tailing edge 42 to the front edge 36. In the FIG. 34 embodiment, however, the upper brim section 56 engages the top surface 22 so in effect close off the open gap 122 so that it only extends from the tailing edge 42 to this point of engagement. As shown in FIG. 35, this open gap 122 extends around the contour of the crown 12 to the base 84, but may shrink in size as it approaches the base 84 as compared to the top of the crown 12. As such, the open gap 122 may extend 180 degrees from one side of the crown 12 to the other opposite side of the crown 12. In other embodiments the open gap 122 may become smaller towards the sides of the crown 12 by the base 84 as the tailing edge 42 tapers in these regions so that the open gap 122 does not extend the entire 180 degrees from side to side. The elevated tailing edge 42 can be incorporated into various embodiments disclosed herein. The upper surface 80 at the top in FIG. 34, which is the center of the brim 14 in the lateral direction, can extend in the same plane from the leading edge 36 all the way back to the tailing edge 42 above and out of engagement with the crown 12. The open gap 122 allows for ventilation of the ball cap 10 and/or allows the ball cap 10 to achieve a certain look.

Figure 36:
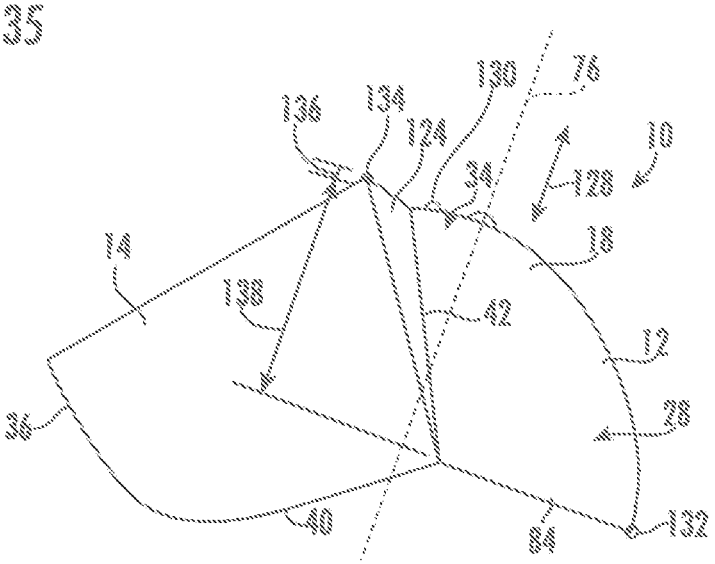
FIG. 36 is a side view of a ball cap with a tapered gap block-off at the rear of the brim.
Figure 37:
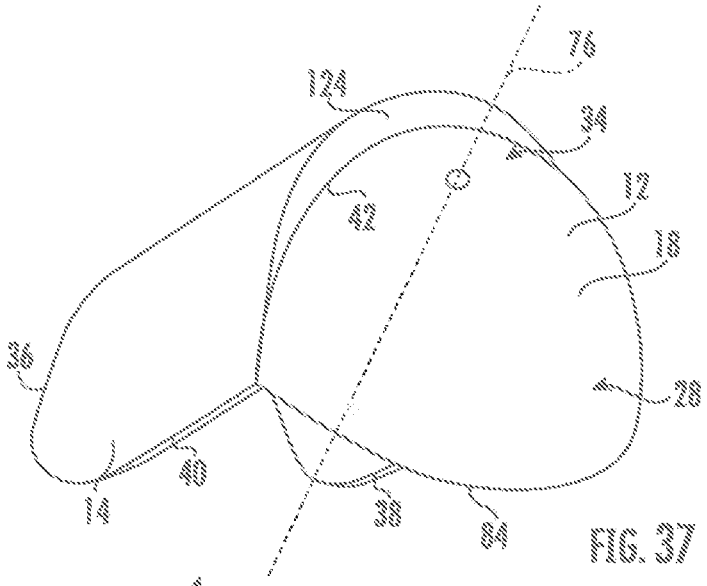
FIG. 37 is a back perspective view of the ball cap of FIG. 36.

FIGS. 36 and 37 show an alternative embodiment in which the brim 14 again has a brim 14 that is elevated at its rearward portion above the top surface 22. This embodiment features a tailing edge 42 that is in the front section 16 but again has a small portion at the back section 18. The tailing edge 42 is located at the crown 12 and not elevated so that an open gap 122 is not defined. Instead, a gap block-off 124 is present to close off any open gap 122 that would otherwise be present between the brim 14 and crown 12. The gap block-off 124 extends from the tailing edge 42 to the elevated section of the brim 14 and results in a beveled block off at the brim 14/crown 12 gap. The gap block-off 124 tapers to termination at the brim 14 side edges 38, 40 at the crown 12 sides bottom edges at the base 84. The brim 14 does not have a upper brim section 56 or a lower brim section 58 in this particular embodiment. The gap block-off 124 although shown as being beveled in these embodiments, could alternatively be perpendicular so that the gap block-off 124 is not visible in the side view of FIG. 36. The gap block-off 124 can be an extension of the brim 14 and thus just the same material as the brim 14, or may be an insert that is of the same or different material than the brim 14. The gap block-off 124 may allow for the placement of text, graphics, or allow the ball cap 10 to achieve a certain look. As with other embodiments, the high brim 14 is arranged so that the distance 136 is less than the distance 138. In the FIG. 36 embodiment, the distance 136 does not form a portion of the distance 138 and is on the other side because the highest brim point 134 is higher in the vertical direction 128 than the highest crown point 130.

Figure 38:
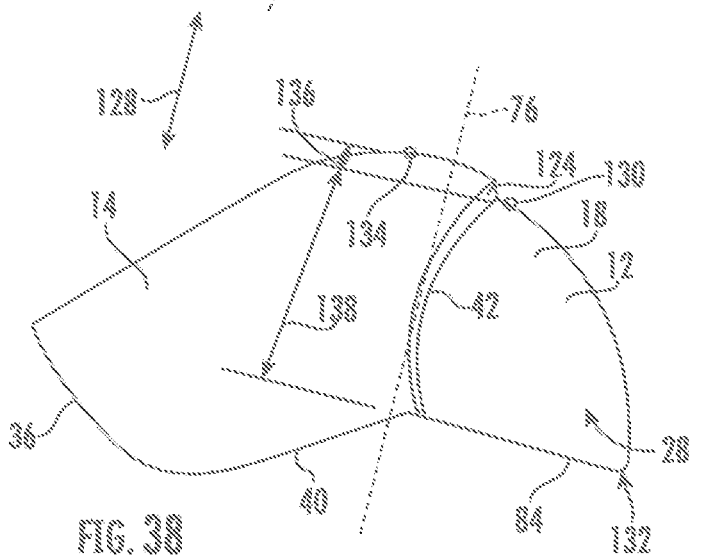
FIG. 38 is a side view of a ball cap with a tailing edge that has a curved element.

The tailing edge 42 can be circumferentially straight as illustrated in the FIGS. 34-37 embodiments. FIG. 38 is a side view of another embodiment of the ball cap 10 in which the brim 14 is again elevated above the crown 12 and extends to the back section 18 so that the tailing edge 42 is located completely at the back section 18 and in no portion of the front section 16. The tailing edge 42 can assume any shape and in the FIG. 38 embodiment has a shape that is circumferentially straight at the top and then curved on the sides and terminates at the bottom in a somewhat straight design. A gap block-off 124 is present and is beveled in appearance along the entire length of the tailing edge 42. In other arrangements, the tailing edge 42 may be circumferentially straight at the top and feature first a convex curve then a concave curve as it runs down the sides of the crown 12 to the base 84 where it is straight. The tailing edge 42 may thus assume any sort of shape, such as being curvy or angled or a combination of these two shapes, in accordance with various exemplary embodiments.

Figure 39:
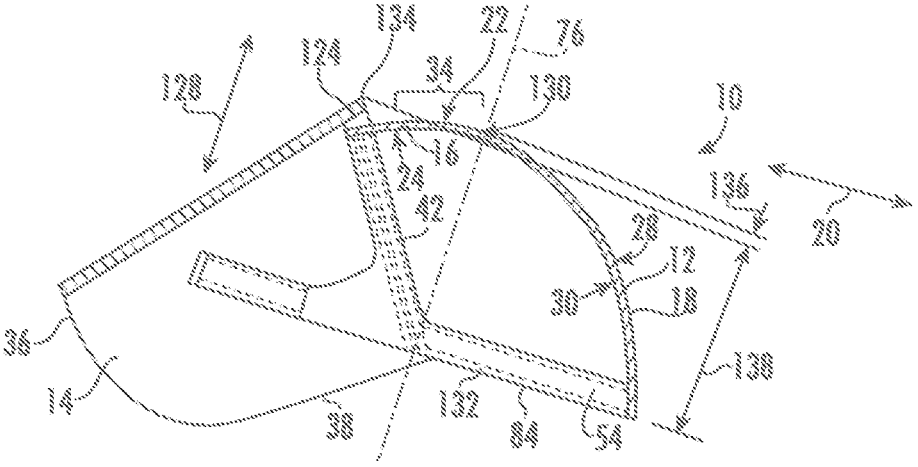
FIG. 39 is a cross-sectional view of a ball cap with an open front crown.

FIG. 39 shows another exemplary embodiment of the ball cap 10 in cross-sectional view in which the sweatband 56 extends 360 degrees around the central axis 76. The brim 14 lacks sections 56, 58 and is arranged short of extension to the back section 18 at the top of the crown 12 so that an uncovered portion 34 is defined. The crown 12 does not form a hemisphere on the head 26. The sweatband 54 has an attachment that extends from one side to another offset from the central axis 76 at an angle. The crown 12 extends from this attachment backwards in the longitudinal direction 20 and is bound at its bottom by the base 84 at the sweatband 54. The tailing edge 42 extends to this attachment and is above it, but a gap block-off 124 is present so that an open gap 122 is not present. The crown 12 is attached to this attachment that is at the gap block-off 124 and tailing edge 42. The crown 12 is not present forward of this attachment in the longitudinal direction 20 so that the head 26 when worn directly faces the inner side of the brim 14 since the crown 12 does not have this forward portion. The brim 14 does not cover any portion of the crown 12 in the disclosed embodiment. The ball cap 10 does not have any support structures 114 in addition to lacking a front section of the crown 12. The attachment of the brim 14 at the angled attachment of the sweatband 54 allows the brim 14 to be supported and properly positioned. Additionally or alternatively, the interior of the brim 14 may engage the head 26 that is between the sweatband 54 and the gap block-off 124 to further support the brim 14.

Figure 40:
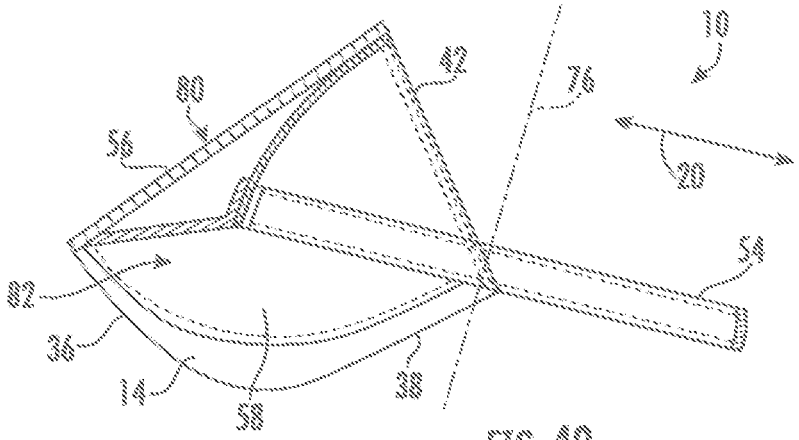
FIG. 40 is a cross-sectional view of a ball cap with a high brim in the form of a visor.

An alternative exemplary embodiment is shown in FIG. 40 with the ball cap 10 being configured into a visor arrangement. The ball cap 10 has a sweatband 54 that surrounds the central axis 76 360 degrees. A crown 12 is completely absent from the ball cap 10, but the ball cap 10 does include a brim 14. The brim 14 has an upper brim section 56 and a lower brim section 58 that can be arranged as previously discussed. No portion of the crown 12 is covered by the brim 14 as the crown 12 is not even present. The lower brim section 58 engages the sweatband 54 around the entire back section of the lower brim section 58 from the brim 14 sweatband 54 side juncture to the other brim 14 sweatband 54 side juncture. The lower brim section 58 also extends upwards from the sweatband 54 generally in the axial direction parallel to the central axis 76 to be above the sweatband 54. The upper brim section 56 overlays the lower brim section 58 and engages it at this upper termination point of the lower brim section 58 and downward along some of its length. The upper brim section 56 then separates from the lower brim section 58 so a gap is present until the upper brim section 56 touches it at the leading edge 36 at the lower brim section 58. The sides of the upper brim section 56 also engages the lower brim section 58 at its sides extending some amount inboard from the sides of the lower brim section 58. As such, some but not all of the upper brim section 56 engages the lower brim section 58. The two brim sections 56, 58 are stiff enough such that they support and maintain the form of the upper surface 80 so that the ball cap 10 functions as a visor with an elevated brim 14.

Figure 41:
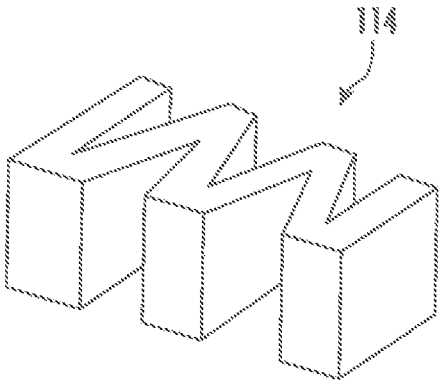
FIG. 41 is a perspective view of a support structure.
Figure 42:
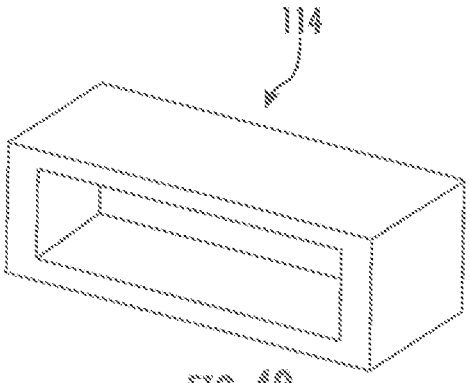
FIG. 42 is a perspective view of another embodiment of the support structure.
Figure 43:
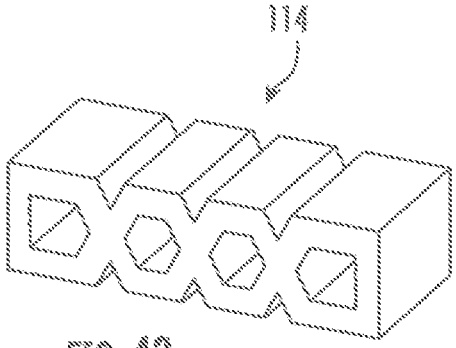
FIG. 43 is a perspective view of a further embodiment of the support structure.

FIGS. 41-43 are three different embodiments of a support structure 114. The support structure 114 In FIG. 41 is an angled, wavy design that has a constant thickness. The support structure 114 extends in the shape of an M. The FIG. 42 embodiment is rectangular in shape with a rectangular void through the middle. The FIG. 43 embodiment has hexagonal elements in the center with square shaped elements at the ends with voids through all of the elements. The support structures 114 shown are made of material, such as plastic, that along with their construction result in an item that can bend or flex yet have sufficient rigidity to hold items in place until a sufficient amount of force is imparted to the structural element 114 so that it will deflect or bend from its initial at rest position. The structural element 114 is pliable in that it can stretch from the initial positions shown and can flex about various axes upon the application of forces thereto.

Figure 44:
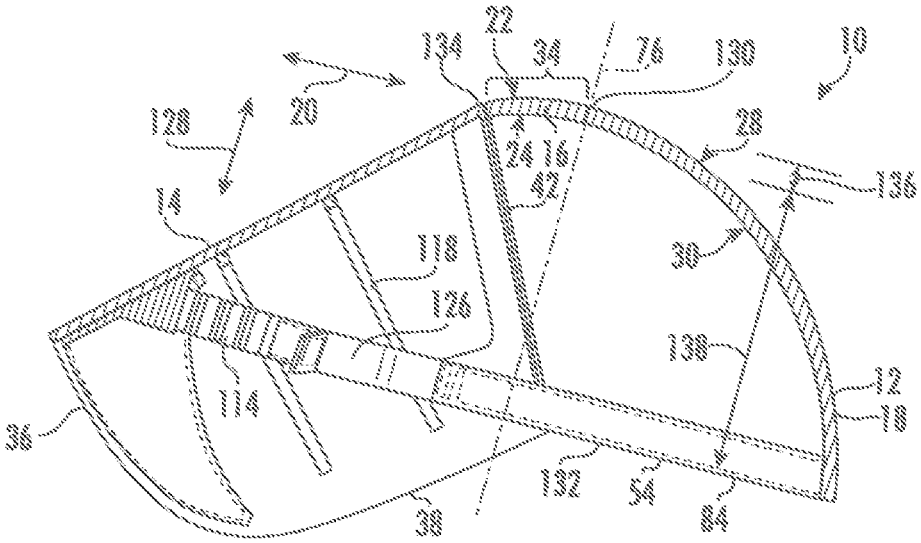
FIG. 44 is a cross-sectional view of a ball cap that includes a support structure.

FIG. 44 is a ball cap 10 that includes the support structure 114. The ball cap 10 has a crown 12 with a front section 16 and a back section 18 as previously discussed. The sweatband 54 extends 360 degrees around the central axis 76 and includes the attachment section as previously discussed in prior embodiments that extends from one side of the ball cap 10 to the other and is at the tailing edge 42. The front section 16 of the crown 12 extends rearward from this attachment section of the sweatband 54. The front area of the crown 12 is missing so that it does not form a hemisphere. The crown 12 does include a front section 16 and is not covered by the brim 14, but the front area of the crown 12 is missing so that there is no front section 16 forward of the attachment section. The crown 12 is thus contained in the area rearward of the attachment section of the sweatband 54. The head 26 of the wearer may engage the underside of the brim 14 or may be spaced therefrom in some arrangements. However, the open forward portion of the crown 12 leaves the head 26 exposed to directly face the brim 14 when the ball cap 10 is worn.

The sweatband 54 features at fit adjustment 126 that can be a hook and loop type fastener attachment that can be used to tighten or loosen the sweatband 54 to achieve a desired fit onto the head 26. Alternatively, the fit adjustment 126 may feature projections and holes into which they are placed for achieving a proper fit (sometimes referred to as a push pin connection), or may use any other type of mechanism for allowing the sweatband 54 to be tightened and loosened. The forward end of the sweatband 54 is attached to the support structure 114. Any configuration of support structure 114 can be employed, and in the embodiment shown it is the M like embodiment of FIG. 41. On an opposite side of the support structure 114, it is attached to the brim 14. The brim 14 has a section that attaches to the support structure 114 that also functions to stiffen the brim 14, but it need only serve as a connection section and not a stiffening section in other embodiments. The brim 14 also includes a pair of brim curvature retention ribs 118 that likewise act to maintain a desired shape of the brim 14. The support structure 114 helps hold the brim 14 outward from the sweatband 54 and head 26 in a desired location. The support structure 114 is made of a different material than the crown 12 and sweatband 54, and in some instances is likewise made of a different material than the brim 14. The support structure 114 is stiff enough to hold the weight of the brim 14 to maintain its position relative to the face of the wearer. Also, the attachment of the sweatband 54 at the tailing edge 42 can likewise function to assist in holding the brim 14 in the desired position.

Figure 45:
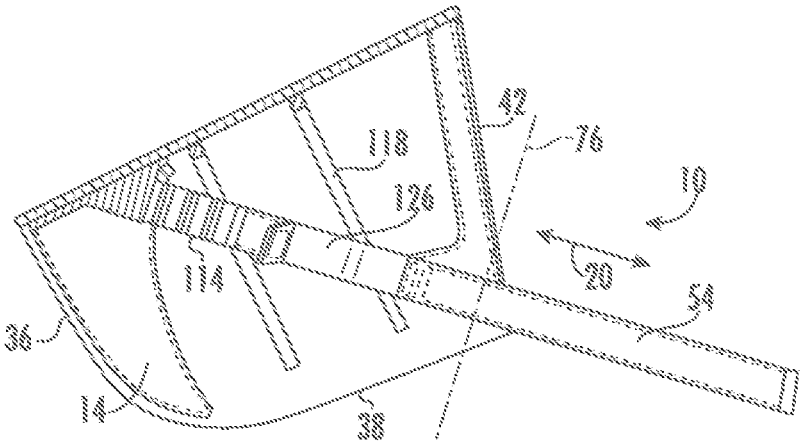
FIG. 45 is a cross-sectional view of a ball cap arranged as a visor that includes a support structure.
Figure 46:
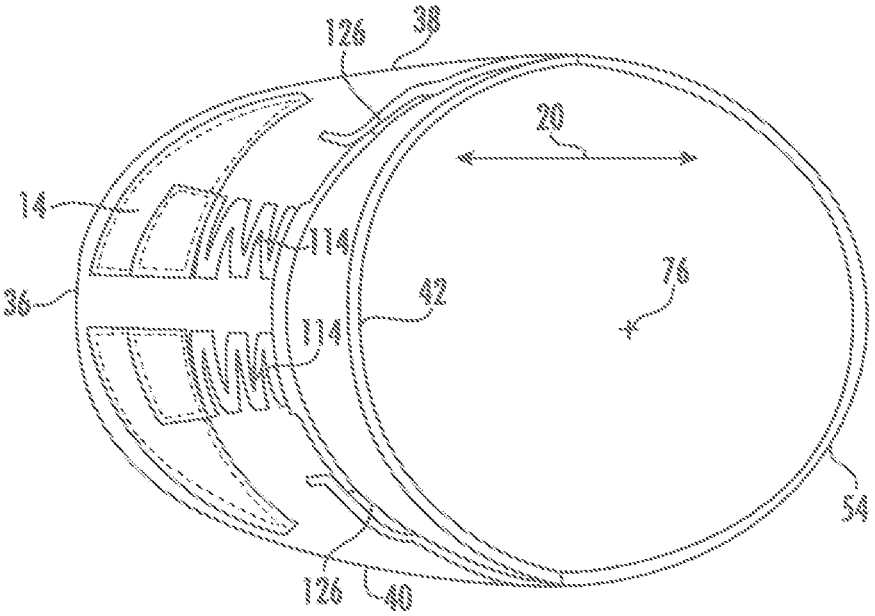
FIG. 46 is a top view of the ball cap of FIG. 45 with some elements omitted for clarity.

FIGS. 45 and 46 show an alternate design of the ball cap 10 in which the ball cap 10 is configured as a visor having the high brim 14. In this embodiment, the crown 12 is not present. The top surface of the brim 14 is not shown in FIG. 46 so that one may better see the elements of this embodiment that will be described. The sweatband 54 extends 360 degrees all the way around the central axis 76 and features a pair of fit adjustments 126 for allowing the user to achieve a desired fit about his or her head 26 when donning the ball cap 10. The fit adjustments 126 can be hook and loop type fasteners that can be fixed so as to extend or shorten the length of the sweatband 56 to achieve the aforementioned desired fit. They are contained under the brim 14 and are not immediately viewable when donning the ball cap 10. Instead of the pair of fit adjustments 126, a single fit adjustment 126 could be present between the pair of support structures 114. Instead of the fit adjustments 126, the sweatband 54 can have one or more stretchable areas to allow the sweatband 54 to stretch into a desired fit when worn. Although described as being adjustable, the ball cap 10 may be non-adjustable and fitted in other embodiments.

A pair of support structures 114 are attached to the sweatband 54 and extend forward therefrom in the longitudinal direction 20. The support structures 114 used are those of FIG. 41 in shape and are attached at an opposite end to a section of the brim 14 that is under the upper surface of the brim 14. The support structures 114 again function to maintain the position of the brim 14 relative to the head 26 of the wearer. The attachment of the sweatband 54 can aid in holding the brim 14 in the proper position for wearing, or this holding can be effected without use of the sweatband 54 attachment and solely through the presence of the one or more support structures 114. The support structures 114 may be made of a material different from the brim 14 and sweatband 54 and in some instances may be made of a material stiffer than these two elements 14, 54. Although two support structures 114 are shown, one may be present in other embodiments, or more than two can likewise be present if desired.

The tailing edge 42 can be variously shaped as previously discussed with respect to the wavy tailing edge 42 of FIGS. 5 and 6. The tailing edge 42 may alternatively be jagged in shape, or may be two straight lines offset from one another in the longitudinal direction 20 and connected by straight lines extending in the longitudinal direction 20 to form a series of right angles. It is to be understood that the tailing edge 42 and resulting seam may assume any shape.

The various embodiments disclosed herein may all be located on the ball cap 10, or any one of or any combination of them may be incorporated into the ball cap 10 in various arrangements. For example, some ball caps 10 may have the high brim 14 and may include the brim adjustment mechanism 44, the sunglass depression 66, the indicia depression 68, the lower brim section support 60, and/or the storage pocket 50. Any of the various features for the ball cap 10 discussed may be included in various combinations as desired.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications, and equivalents as can be included within the spirit and scope of the following claims.

What is claimed:

1. A ball cap, comprising:

a crown that has a front section and a back section that are oriented next to one another in a longitudinal direction of the ball cap, wherein the front section has a top surface and a bottom surface, wherein the bottom surface of the front section engages a head of a wearer of the ball cap when worn, wherein the back section has a top surface and a bottom surface, wherein the bottom surface of the back section engages the head of the wearer of the ball cap when worn, wherein the crown has a highest crown point and a lowest crown point in a vertical direction;

a brim that covers a portion of the top surface of the front section, wherein the brim does not cover an entirety of the top surface of the front section such that the top surface of the front section has an uncovered portion, wherein the brim has a highest brim point in the vertical direction, and wherein the highest brim point is closer to the highest crown point than to the lowest crown point in the vertical direction, wherein the brim has a left side edge and a right side edge, wherein the brim has a leading edge, wherein the leading edge is located forward from the crown in the longitudinal direction of the ball cap, wherein a tailing edge extends across the top surface of the front section in a curved direction, wherein the brim has an incurvation;

wherein the highest brim point is located at a midpoint of the brim in a lateral direction, wherein the tailing edge of the brim is attached to and engages the top surface of the front section an entire way in an extension that is continuously upwards in the vertical direction upon moving forward in the longitudinal direction from the left side edge to the highest brim point, wherein the left and right side edges are located lower than the lowest crown point in the vertical direction and the tailing edge extends to a position in the vertical direction that is at a same position in the vertical direction as the lowest crown point on both a right side and left side of the crown, wherein the tailing edge continuously engages the top surface of the front section the entire way from the left side edge that is at the same position in the vertical direction as the lowest crown point to the highest brim point, wherein the brim is nonadjustable and wherein the brim covers a majority of the front section of the crown wherein the front section is a front half of the crown and an entirety of the front half is a solid surface such that the portion of the top surface of the front section that is covered by the brim is a portion of the solid surface that extends from engagement with the brim at the highest brim point to the lowest crown point;

wherein an entire extent of the tailing edge from the left side edge that is at the position in the vertical direction that is at the same position in the vertical direction as the lowest crown point to the highest brim point extends completely continuously at all times both forward in the longitudinal direction and upward in the vertical direction;

wherein the brim has a lower surface that has an uncovered portion such that the uncovered portion directly faces the wearer of the ball cap when worn, wherein no portion of the ball cap covers the uncovered portion of the lower surface, wherein an entirety of the lower surface is an unopenable surface at all locations of the lower surface.

2. The ball cap as set forth in claim 1, wherein the brim has a brim curvature retention rib that functions to maintain a shape of the brim.

3. The ball cap as set forth in claim 1, wherein the brim defines a sunglass depression that is a depression in an upper surface of the brim, wherein the sunglass depression is located between the leading edge of the brim and the tailing edge of the brim.

4. The ball cap as set forth in claim 1, wherein the brim defines at least one depression or protrusion in an upper surface of the brim.

* * * * *